US005984014A

United States Patent [19]

Poullard et al.

[11] Patent Number: 5,984,014

[45] Date of Patent: Nov. 16, 1999

[54] PRESSURE RESPONSIVE WELL TOOL WITH INTERMEDIATE STAGE PRESSURE POSITION

[75] Inventors: Jason P. Poullard, Irving, Tex.; Ronald Lee Hinkie, Marlow, Okla.

[73] Assignee: Halliburton Energy Services, Inc., Dallas, Tex.

[21] Appl. No.: 08/980,594

[22] Filed: Dec. 1, 1997

[51] Int. Cl.[6] ..... E21B 34/10

[52] U.S. Cl. ..... 166/374; 166/386; 166/387; 166/324

[58] Field of Search ..... 166/373, 374, 166/386, 387, 321, 324

[56] References Cited

U.S. PATENT DOCUMENTS

| | | | |
|---|---|---|---|
| 4,423,782 | 1/1984 | Bowyer | 166/188 X |
| 4,633,952 | 1/1987 | Ringgenberg . | |
| 5,209,303 | 5/1993 | Barrington | 166/323 X |
| 5,482,119 | 1/1996 | Manke et al. . | |

*Primary Examiner*—Roger Schoeppel
*Attorney, Agent, or Firm*—William M. Imwalle; John F. Booth

[57] ABSTRACT

A pressure responsive well tool is provided of the general type including a housing having a flow conducting passage therethrough, a pressure conducting channel formed in the housing, and a spring assembly in the housing for storing potential energy in response to an increase in fluid pressure within the pressure conducting channel and releasing the stored potential energy into the pressure conducting channel in response to a decrease in fluid pressure within the pressure conducting channel. A staged latching assembly is operatively connected to the spring assembly for providing at least one intermediate stage pressure position for the spring assembly. The staged latching assembly preferably includes interfering structures on a mandrel and a collet for providing the intermediate stage pressure position. The intermediate stage pressure position of the spring assembly can be used as a stage for selectively directing the spring assembly in either direction, thereby providing better control over the tool. The staged latching assembly can be incorporated into a multi-mode well tool having a ball valve assembly and a circulating assembly to assist in selectively controlling the operation of the tool between a well test mode, a blank mode, any a fluid circulating mode. A method of operating a well tool is also provided.

49 Claims, 37 Drawing Sheets

PRESSURE RESPONSIVE WELL TOOL WITH INTERMEDIATE STAGE PRESSURE POSITION

TECHNICAL FIELD

The present invention relates to pressure responsive well tools. The invention has an exemplary application in multi-mode testing tools that are operable in several modes such as a drill-pipe tester, formation tester, circulation valve and displacement valve.

BACKGROUND OF THE INVENTION

In oil and gas wells, it is common to conduct well testing and stimulation operations to determine production potential and enhance that potential. Annulus pressure responsive downhole tools have been developed which operate responsive to pressure changes in the annulus between the testing string and the well bore casing and ran sample formation fluids for testing or circulating fluids therethrough. These tools typically incorporate both a valve ball and lateral circulation ports. Both the valve ball and circulation ports are operable between open and closed positions.

A tool of this type is described in U.S. Pat. No. 4,633,952 issued to Ringgenberg and assigned to Halliburton Company. A commercially available multi-mode testing tool of this type is the "Omni SandGuard IV Circulating Valve." The tool is capable of performing in different modes of operation as a drill pipe tester valve, a circulation valve and a formation tester valve, as well as providing its operator with the ability to displace fluids in the pipe string above the tool with nitrogen or another gas prior to testing or retesting. A popular method of employing the circulating valve is to dispose it within a well bore and maintain it in a well test position during flow periods with the valve ball open and the circulation ports closed. At the conclusion of the flow periods, the tool is moved to a circulating position with the ports open and the valve closed. The tool is operated by a ball and slot type ratchet mechanism which provides opening and closing of the valve responsive to a series of annulus pressure increases and decreases.

Unfortunately, the changing between tool modes in the type of tool described in U.S. Pat. No. 4,633,952 is limited in that the ratchet dictates preprogrammed steps for changing the tool between its different positions. An operator must follow each of the preprogrammed steps to move the tool between positions. A standard circulating valve ratchet, for instance, requires 15 cycles of pressurization and depressurization in the annulus to move the tool out of the well test position, into the circulating position and back again. This process requires approximately one hour.

It is desirable, therefore, to employ a tool which allows an operator to shift the tool from a well test position to a circulating position with a minimum of pressure cycles. An operator would be able to maintain his tool in the well test position and close the tool when desired without following a preprogrammed cycle schedule. The number and times of closures could be orchestrated in accordance with programs established by reservoir engineers or supervisors.

A tool of this type is described in U.S. Pat. No. 5,482,119 issued to Kevin R. Manke and Curtis Wendler and assigned to Halliburton Company, entitled "Multi-Mode Well Tool With Hydraulic Bypass Assembly. The specification of U.S. Pat. No. 5,482,119 is hereby incorporated by reference in its entirety. This annulus pressure responsive tool contains lateral circulation ports and a valve ball, each of which are operable between open and closed positions to configure the tool into different modes of operation. These modes include a well test position in which the valve ball is open and the circulation ports are closed, a blank position in which the valve ball and circulation ports are both closed, and a circulating position in which the valve ball is closed and the circulation ports are open. Through manipulation of annulus pressure, the tool mode can be changed upon reduction or release of annulus pressure to move the tool out of the well test position and into the blank and circulating positions.

The type of tool described in U.S. Pat. No. 5,482,119 includes an operating mandrel assembly that is slidably disposed within the exterior housing of the tool whose movement dictates the positions of both the circulation ports and the valve ball. The operating mandrel is moveable by means of an annulus pressure conducting channel which is capable of receiving, storing and releasing annulus pressure increases.

A ratchet assembly associates the operating mandrel assembly and housing and functions as an overrideable position controller which dictates response and movement of the operating mandrel assembly to annulus pressure changes. The ratchet assembly contains a pair of ratchet balls which travel in ratchet slots on a ratchet slot sleeve. The ratchet slots feature a well test travel path within which the ratchet balls are maintained during normal operation of the tool in its well test position. A secondary ratchet path is contiguous to the well test path. The ratchet balls may be redirected into the secondary ratchet path and moved to ratchet ball positions which permit the operating mandrel assembly to be moved to positions corresponding to blank and circulating modes for the tool.

A fluid metering assembly includes upward and downward fluid paths for flow during annular pressure changes. The upward flow path toward the fluid spring during annulus pressurization permits relatively unrestricted fluid flow. The downward flow path away from the fluid spring during a release of annulus pressure provides metered flow to provide an operator sufficient time to generate an annulus pressure increase to move the rachet balls out of the well test travel path and into the secondary path.

A hydraulic bypass assembly is included which selectively reduces the time required for portions of the metered transmission of stored fluid pressure away from the fluid spring. The bypass assembly includes a bypass mandrel and associated fluid communication bypass grooves which increase the flow of fluid away from the fluid spring and toward the rachet assembly during portions of the pressure release operation.

Nevertheless, a tool of the type disclosed in U.S. Pat. No. 5,482,119, while more flexible and faster in operation than earlier designs, still depends on a precision combination of time and pressure to control the positions of the tool. This design requires timed cycles of pressure up and bleed-off. It would be desirable, therefore, to employ an improved tool which will allow an operator to shift the tool from a well test position to a circulating position based on the principle of pressure alone. This would result is substantially simplified operation and improve the ability to control the modes of the tool. In addition, the operation time would be further reduced if the metering mechanism could be eliminated.

SUMMARY OF THE INVENTION

A pressure responsive well tool is provided of the general type including a housing having a flow conducting passage therethrough, a pressure conducting channel formed in the housing, and a spring assembly in the housing for storing potential energy in response to an increase in fluid pressure within the pressure conducting channel and releasing the stored potential energy into the pressure conducting channel in response to a decrease in fluid pressure within the pressure conducting channel.

A staged latching assembly is operatively connected to the spring assembly for providing at least one intermediate stage pressure position for the spring assembly. The staged latching assembly preferably includes a first member and a second member operatively positioned to allow relative movement between the two members. Interferring structures on the first member and the second member provide the intermediate stage pressure position for the spring assembly. For example, the first member can be operatively connected to move with the spring assembly relative to a fixed position of the second member. According to the presently most preferred embodiment of the invention, the first member is a mandrel operatively connected to move with the spring assembly and the second member is a collet. According to a presently most preferred embodiment of the invention, the collet is a double collet. The intermediate stage pressure position of the spring assembly can be used as a stage for selectively directing the spring assembly in either direction from the intermediate stage position, thereby providing better control over the tool. As will be appreciated by those skilled in the art, however, the first member can be, for example, the housing of the well tool and the second member can be, for example, a collet operatively connected to move with or in response to the potential energy position of the spring assembly, the collet moving relative to the housing.

According to an example of the preferred embodiment of the invention, the spring assembly is moved from a first pressure position to a second pressure position in response to an increase in pressure within the pressure conducting channel. The spring assembly is moved from the second pressure position to an intermediate stage pressure position in response to a partial decrease in pressure within the pressure conducting channel. The spring assembly is selectively moved from the intermediate stage pressure position to the first pressure position in response to a further decrease in pressure within the pressure conducting channel. In the alternative, the spring assembly is selectively moved from the intermediate stage pressure position to the second pressure position in response to an increase in pressure within the pressure conducting channel. Thus, selective and discrete control of the movement of the spring between the first, second, and intermediate stage pressure positions is achieved by effecting changes in the pressure within the pressure conducting channel. As will be appreciated by one skilled in the art, whether the spring assembly is biased in one direction or the other is not critical to the practice of the invention, for example, the spring assembly can be designed too move from the first pressure position to the second pressure position in response to a decrease, rather than an increase, in the pressure within the pressure conducting channel.

The pressure conducting channel preferably includes a passageway in fluid communication with the exterior of the housing, whereby the pressure within the pressure conducting channel is controlled by changes in annulus pressure. Remote control of annulus pressure can be effected by a pump and a control conduit to the annulus outside the downhole tool. It is to be understood, however, that changes in the pressure within the pressure conducting channel can be effected by other pressure sources, such as changes in the fluid pressure conducted through the fluid conducting passageway within the housing, without departing from the scope and spirit of the principles of the invention.

According to a preferred embodiment of the invention, the spring assembly is a fluid spring assembly, including a typical pressurized gas chamber and a piston or other cooperating structures known in the art. It is to be understood, however, that any type of spring assembly, such as a coil spring, can be employed depending on the nature of the tool and the downhole application in accordance with the principles of the invention.

The invention can be advantageously employed in a multi-mode well tool having a ball valve assembly and a circulating assembly to assist in selectively controlling the operation of the tool between a well test mode, a blank mode, and a fluid circulating mode. For example, the staged latching assembly can be used to assist in the control of an operating mandrel and overridable position controller, such as a ball and slot rachet assembly having a primary and a secondary rachet slot paths.

A method of operating a well tool according to the principles of the invention is also provided. The method includes the step of providing a tool for use in a tubing string disposed in a well bore. The tool includes a housing having a flow conducting passage therethrough; a pressure conducting channel in the housing; a spring assembly in the housing for storing potential energy in response to an increase in fluid pressure within the pressure conducting channel and releasing the stored potential energy into the pressure conducting channel in response to a decrease in fluid pressure within the pressure conducting channel; and a staged latching assembly operatively connected to the spring assembly for providing the intermediate stage pressure position for the spring assembly. The method further includes the steps of changing the pressure in the pressure conducting channel to configure the tool such that the spring assembly is in the intermediate stage pressure position; and selectively increasing or decreasing the pressure in the pressure conducting channel to configure the tool into a mode in which the spring assembly is in a first pressure position or a second pressure. This ability to select which direction to move from the intermediate stage pressure position of the spring assembly provides an improved method of controlling a pressure responsive well tool. This method of operating a well tool can be advantageously incorporated into a method of operating a multi-mode well tool.

BRIEF DESCRIPTION OF THE DRAWING

The accompanying drawings are incorporated into and form a part of the specification to provide illustrative examples of the present invention and to explain the principles of the invention. The drawings are only for purposes of illustrating preferred and alternate embodiments of how the invention can be made and used. The drawings are not to be construed as limiting the invention to only the illustrated and described examples. Various advantages and features of the present invention will be apparent from a consideration of the accompanying drawings in which:

FIGS. 2A–2K are a vertical half section of an exemplary tool according to the present invention, showing in FIGS. 2B–2D the latching assembly in a depressurized position (e.g., corresponding to position a as described with respect to FIG. 5) and showing in FIGS. 2E–2K the valve assembly open and the circulating assembly closed according to a well test mode;

FIGS. 3A–3K are a vertical half-section of the tool of FIG. 2, showing in FIGS. 3B–3D the latching assembly in a pressurized position (e.g., corresponding to position b of the rachet slot path as described with respect to FIG. 5) and showing in FIGS. 3E–3K both the valve assembly and the circulating assembly closed according to a blank mode;

FIGS. 4A–4K are a vertical half-section of the tool of FIG. 2, showing in FIGS. 4B–4D the latching assembly in an intermediate stage pressure position (e.g., corresponding to position c of the rachet slot path as described with respect to FIG. 5) and showing in FIGS. 4E–4K the valve assembly closed and the circulating assembly open according to a fluid circulation mode;

DETAILED DESCRIPTION OF PREFERRED EMBODIMENTS

Representative Environment for a Pressure Responsive Well Tool

Figure 1:
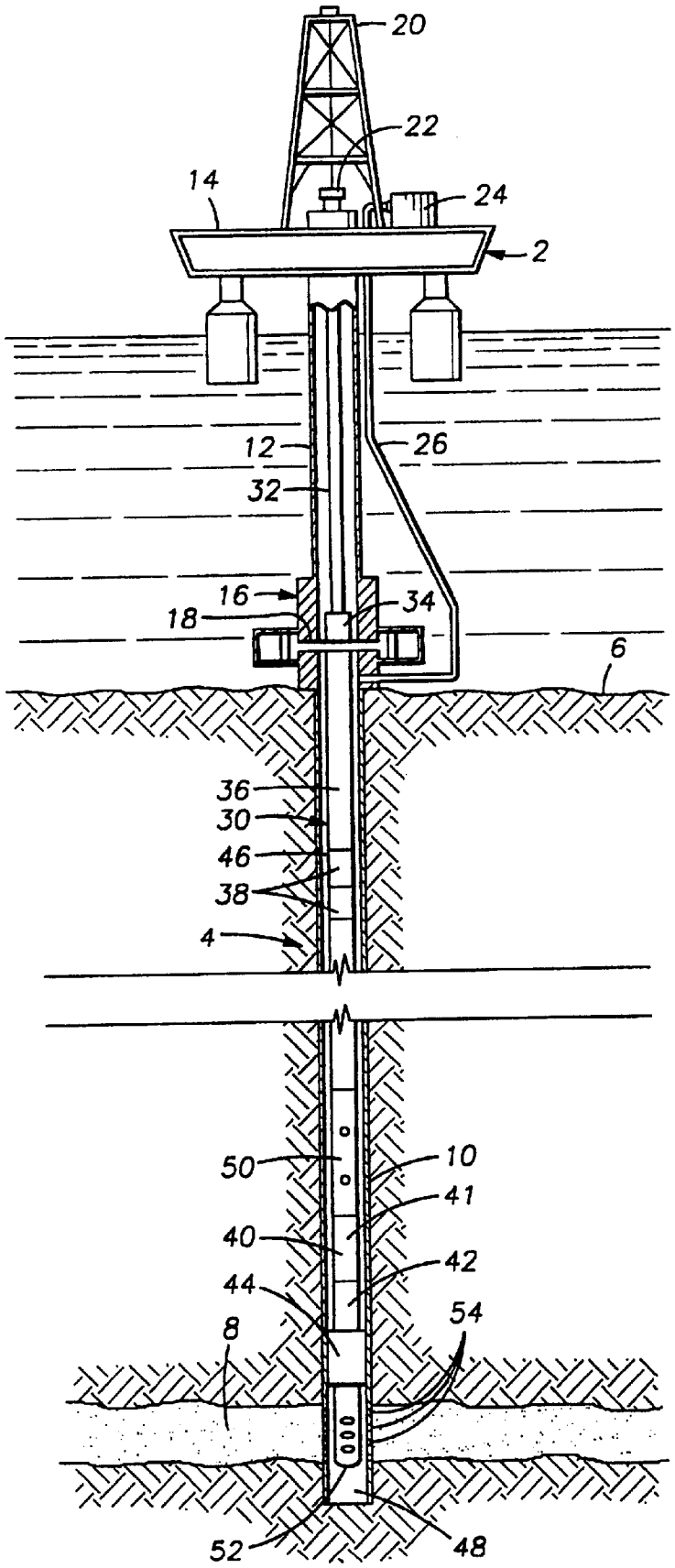
FIG. 1 provides a schematic vertical section view of a representative offshore well with a platform from which testing may be conducted and illustrates a formation testing string or tool assembly in a submerged well bore at the lower end of a string of drill pipe which extends upward to the platform.

Referring to FIG. 1, a well tool according to the present invention is shown schematically incorporated in a testing string deployed in an offshore oil or gas well. It is to be understood, of course, that the well tool can be used in land based well environments.

Platform 2 is shown positioned over a submerged oil or gas well bore 4 located in the sea floor 6, well bore 4 penetrating potential producing formation 8. Well bore 4 is shown to be lined with steel casing 10, which is cemented into place. A subsea conduit or riser 12 extends from the deck 14 of platform 2 to a subsea wellhead 16, which includes a blowout preventer 18. Platform 2 supports a derrick 20 thereon, as well as a hoisting apparatus 22, and a pump 24 which communicates with the well bore 4 via control conduit 26, which extends to annulus 46 below blowout preventer 18.

A testing string 30 is shown disposed in well bore 4, with blowout preventer 18 closed thereabout. Testing string 30 includes an upper drill pipe string 32 which extends downward from platform 2 to wellhead 16, whereat is located a hydraulically operated "test tree" 34, below which extends intermediate pipe string 36. Slip joint 38 may be included in string 36 to compensate for vertical motion imparted to platform 2 by wave action; slip joint 38 may be similar to that disclosed in U.S. Pat. No. 3,354,950 to Hyde. Below slip joint 38, intermediate string 36 extends downwardly to a multi-mode testing tool 50 of the present invention. Below multi-mode tool 50 is a lower pipe string 40, extending to a tubing seal assembly 42, which stabs into a packer 44. Above the tubing seal assembly 42 on the lower pipe string 40 is a tester valve 41 which may be of any suitable type known in the art. When set, packer 44 isolates upper well bore annulus 46 from lower well bore 48. Packer 44 may be any suitable packer well known in the art, such as, for example, a Baker Oil Tool Model D packer, an Otis Engineering Corporation Type W packer, or Halliburton Services "CHAMP(r)", "RTTS", or "EZDRILL(r) SV" packers. Tubing seal assembly 42 permits testing string 30 to communicate with lower well bore: 48 through a perforated tail pipe 52. In this manner, formation fluids from formation 8 may enter lower well bore 48 through the perforations 54 in casing 10, and flow into testing string 30.

After packer 44 is set in well bore 4, a formation test for testing the production potential of formation 8 may be conducted by controlling the flow of fluid from formation 8 through testing string 30 using variations in pressure to operate tool 50. The pressure variations are effected in upper annulus 46 by pump 24 and control conduit 26, utilizing associated relief valves (not shown). Prior to the actual test, however, the pressure integrity of testing string 30 may be tested with the valve ball of the multi-mode tool 50 closed in the tool's drill pipe tester mode. Tool 50 may be run into well bore 4 in its drill pipe tester mode, or it may be run in its circulation valve mode to automatically fill with fluid, and be cycled to its drill pipe mode thereafter. As the valve ball in tool 50 of the present invention is opened and closed in its formation tester valve mode, formation pressure, temperature, and recovery time may be measured during the flow test through the use of instruments incorporated in testing string 30 as known in the art. Such instruments are well known in the art, and include both Bourdon tube-type mechanical gauges, electronic memory gauges, and sensors run on wireline from platform 2 inside testing string 30 prior to the test. If the formation to be tested is suspected to be weak and easily damageable by the hydrostatic head of fluid in testing string 30, tool 50 may be cycled to its displacement mode and nitrogen or other inert gas under pressure employed to displace fluids from the string prior to testing or retesting.

It may also be desirable to treat the formation 8 in conjunction with the testing program while testing string 30 is in place. Treatment programs may include hydraulically fracturing the formation or acidizing the formation. Such a treatment program is conducted by pumping various chemicals and other materials down the flow bore of testing string 30 at a pressure sufficient to force the chemicals and other materials into the formation. The chemicals, materials, and pressures employed will vary depending on the formation characteristics and the desired changes thought to be effective in enhancing formation productivity. In this manner, it is possible to conduct a testing program to determine treatment effectiveness without removal of testing string 30. If desired, treating chemicals may be spotted into testing string 30 from the surface by placing tool 50 in its circulation valve mode, and displacing string fluids into the annulus prior to opening the valve ball in tool 50.

At the end of the testing and treating programs, the circulation valve mode of tool 50 is employed, the circulation valve opened, and formation fluids, chemicals and other injected materials in testing string 30 circulated from the interior of testing string 30 are pumped back up the testing string 30 using a clean fluid. Packer 44 is then released (or tubing seal 42 withdrawn if packer 44 is to remain in place) and testing string 30 withdrawn from well bore 4.

Structure of a Well Tool According to Invention

FIGS. 2A–2K illustrate a well tool 50 which is similar in some respects to that described in U.S. Pat. No. 5,482,119 issued to Kevin R. Manke and Curtis Welder and assigned to the assignee of the present invention and which is incorporated herein by reference in its entirety. Tool 50 is shown in section, enclosing a central flow conducting passage 56. As may be appreciated by reference to the drawings, connections of components are often complimented by the use of O-rings or other conventional seals. The use of such seals is well known in the art and, therefore, will not be discussed in detail.

Fluid Spring Assembly

Commencing at the top of the tool 50, upper adapter 100 has threads 102 therein at its upper end, whereby tool 50 is secured to drill pipe in the testing string 30. Upper adapter 100 is secured to nitrogen valve housing 104 at threaded connection 106. Housing 104 contains a valve assembly (not shown), such as is well known in the art, and a lateral bore 108 in the wall thereof communicating with downwardly extending longitudinal nitrogen charging channel 110. Valve housing 104 is secured by threaded connection 112 at its outer lower end to tubular pressure case 114, and by threaded connection 116 at its inner lower end to gas chamber mandrel 118. Case 114 and mandrel 118 define a pressurized gas chamber 120 and an upper oil chamber 122, the two being separated by a annular floating piston 124. Channel 110 is in communication with chamber 120.

Upper Portion of Pressure Conducting Channel

The upper end of oil channel coupling 126 extends between case 114 and gas chamber mandrel 118, and is secured to the lower end of case 114 at threaded connection 128. Upper oil chamber 122 is in fluid communication with a plurality of longitudinal oil channels 130. Longitudinal oil channels 130 are spaced around the circumference of coupling 126 (one shown) and extend from the upper terminal end of coupling 126 to the lower terminal end thereof. Radially drilled oil fill ports 132 extend from the exterior of tool 50, intersecting with channels 130 and closed with plugs 134. The lower end of coupling 126, includes a downwardly facing lower side 127 and is secured at threaded connection 140 to the upper end of connector housing 123.

Connector housing 123 is connected at its lower portion by threaded connection 125 to a fluid flow housing 142, which is constructed primarily of upper and lower fluid flow housings 144 and 146.

The upper fluid flow housing 144 is connected at its lower portion by threaded connection 154 to the lower fluid flow housing 146 which is, in turn, connected at thread 156 to ratchet case 158, with oil fill ports 160 extending through the wall of rachet case 158 and closed by plugs 162. Ratchet case 158 presents an inwardly projecting, upwardly facing annular shoulder 164 (see FIG. 2E) on its inner surface which forms and separates an upper expanded bore 166 from a lower reduced diameter bore 168 below. The expanded bore 166 defines a ratchet chamber 170.

The lower fluid flow housing 146 includes a pair of longitudinal passages 172 which communicates fluid between ratchet chamber 170 below and a lower annular gap 176 above defined at the connection of upper fluid flow housing 144 and lower fluid flow housing 146. The upper fluid flow housing 144 includes a pair of longitudinal passages 180 which run between the lower annular gap 176 and the first intermediate oil chamber 129.

Staged Latching Assembly

A latching mandrel 200 (FIGS. 2B–2D) is disposed within oil channel coupling 126, connector housing 123, and fluid flow housing 142. According to the presently most preferred embodiment of the invention, the latching mandrel 200 has a circumferential lug 202 extending outwardly therefrom. A first intermediate oil chamber 129 is formed between mandrel 200 and housing 123 with coupling 126 at its upper end and fluid flow housing 142 at its lower end.

A double collet 204 is connected at threaded connection 205 to the upper fluid flow housing 144 within first intermediate oil chamber 129. Double collet includes a sleeve 206 and a plurality of collet fingers 207 extending upwardly from the sleeve 206. Each of the collet fingers 207 has a first knuckle 208 and a second knuckle 209, which are adapted to engage the outwardly facing lug 202 of latching mandrel. The mandrel 200 and double collet 204 according to the presently most preferred embodiment of the invention is shown in more detail in FIGS. 6–9. The structural material and dimensions of the double collet fingers 207 and the dimensions and angles of the lug 202 and the knuckles 208 and 209 are designed such that the lug 202 slips past the knuckles 208 and 209 at substantially different downhole pressures transmitted to the mandrel 207.

An annular piston 210 (FIG. 2C) is disposed within the first intermediate oil chamber 129 and affixed by lock rings 212 to latching mandrel 200 to be axially moveable therewith. Piston 210 includes a longitudinal bore 211 therethrough having upper and lower enlarged diameter portions. An upper check valve 214 with an upwardly extending dart 216 within its upper end is disposed within the upper enlarged portion of bore 211. The upper check valve 214 is spring biased into a normally closed position which blocks upward fluid flow across it through the piston 210 but will permit downward fluid flow under pressure. Downward force upon the dart 216 will open the upper check valve to permit upward fluid flow therethrough. Lower check valve 218 is oppositely disposed from the upper check valve 214 within the lower enlarged portion of bore 211 of piston 210 and carries a downwardly extending dart 220 within its lower end. It is spring biased into a normally closed position against downward fluid flow, but will permit upward fluid flow under pressure. Upward force upon the dart 220 will open the lower check valve 218 to downward fluid flow therethrough.

The latching mandrel 200 is axially slidable with respect to the oil channel coupling 126, housing 123, first intermediate oil chamber 129 and the fluid flow housing 142 between an upper position proximate the lower end of gas chamber mandrel 118 and a lower position proximate the upper end of ratchet slot mandrel 222.

Position Controller

Ratchet slot mandrel 222 extends upward from within ratchet case 158. The upper exterior 224 of ratchet slot mandrel 222 has a reduced, substantially uniform diameter, while the lower exterior 226 has a greater diameter so as to provide sufficient wall thickness for ratchet slots 228. Ratchet slot mandrel 222 includes an annular member 231 projecting radially outward and forming a piston seat 230 which faces upwardly and outwardly at the base of the upper exterior 224 of mandrel 222. There are preferably two such ratchet slots 228 extending longitudinally along the lower exterior of the ratchet slot mandrel 222. The ratchet slot mandrel 222 is axially slidable within tool 50 between upper and lower positions as will be described in greater detail shortly.

A ball sleeve assembly 234 surrounds ratchet slot mandrel 222 and comprises shuttle piston 236, upper sleeve 238, lower sleeve 240 and clamp 242 which connects sleeves 238 and 240.

Shuttle piston 236 is constructed similarly in structure and function to annular piston 210 and is fixedly attached to or unitarily fashioned with upper sleeve 238. The shuttle piston 236 surrounds the upper exterior 224 of the ratchet slot mandrel 222 within the ratchet chamber 170. Shuttle piston 236 includes a longitudinal bore 237 therethrough having upper and lower enlarged diameter portions. An upper check valve 244 with upwardly extending dart 246 within its upper end is disposed in the upper enlarged portion, and lower check valve 248 with downwardly extending dart 250 within its lower end is disposed within the lower enlarged portion. The lower check valve 248 and dart 250 are shown as angled outwardly within the shuttle piston 236 such that the dart 250 contacts shoulder 164 when ball sleeve assembly 234 is moved downward within the ratchet case 158.

The lower end 252 of the ratchet slot mandrel 222 is secured at threaded connection 254 to extension mandrel 256. A radial clearance 258 is present between the radial exterior of lower end 252 and the interior surface of ratchet case 158. The lower end 260 of ratchet case 158 is secured at threaded connection 262 to extension case 264 which surrounds the extension mandrel 256. An annular second intermediate oil chamber 266 is defined by ratchet case 158 and extension mandrel 256. The second intermediate oil chamber 266 is connected by oil channels 268 to lower oil chamber 270. Annular floating piston 272 slidingly seals the bottom of lower oil chamber 270 and divides it from the lower fluid chamber 274 into which pressure ports 282 in the wall of case 264 open.

The general construction and operation of ratchet-type assemblies is well known in the art. Particular reference is made to U.S. Pat. No. 4,557,333 issued to Beck, U.S. Pat. No. 4,667,743 issued to Ringgenberg et al. and U.S. Pat. No. 4,537,258 issued to Beck, all of which are assigned to the assignee of the present invention and which are incorporated herein by reference. As will be appreciated by the discussion that follows, the tool 50 of the present invention incorporates a novel ratchet assembly having a dual-path ratchet slot within which a ratchet member is directed. The primary path is cyclical and maintains the tool's components in the well test mode. The secondary path is contiguous to the first path, and redirection of the ratchet member into the second path permits the tool's components to be altered so that the tool may be reconfigured into alternative modes of operation.

Figure 2A:
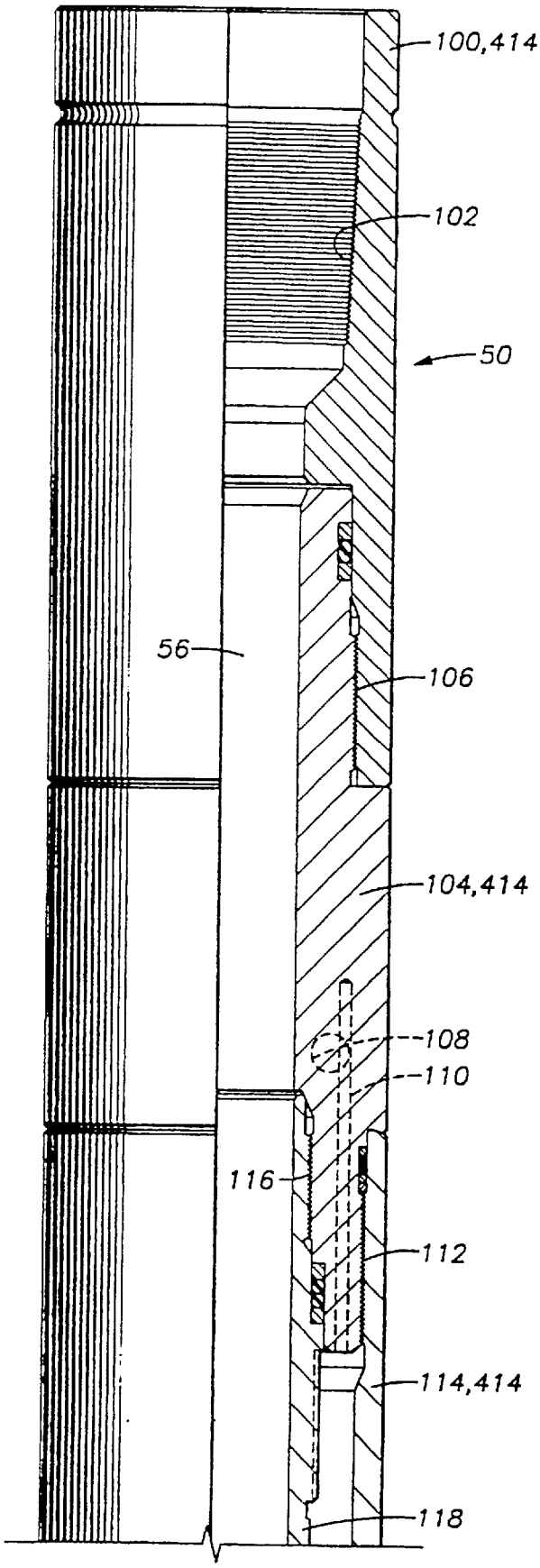
Figure 2B:
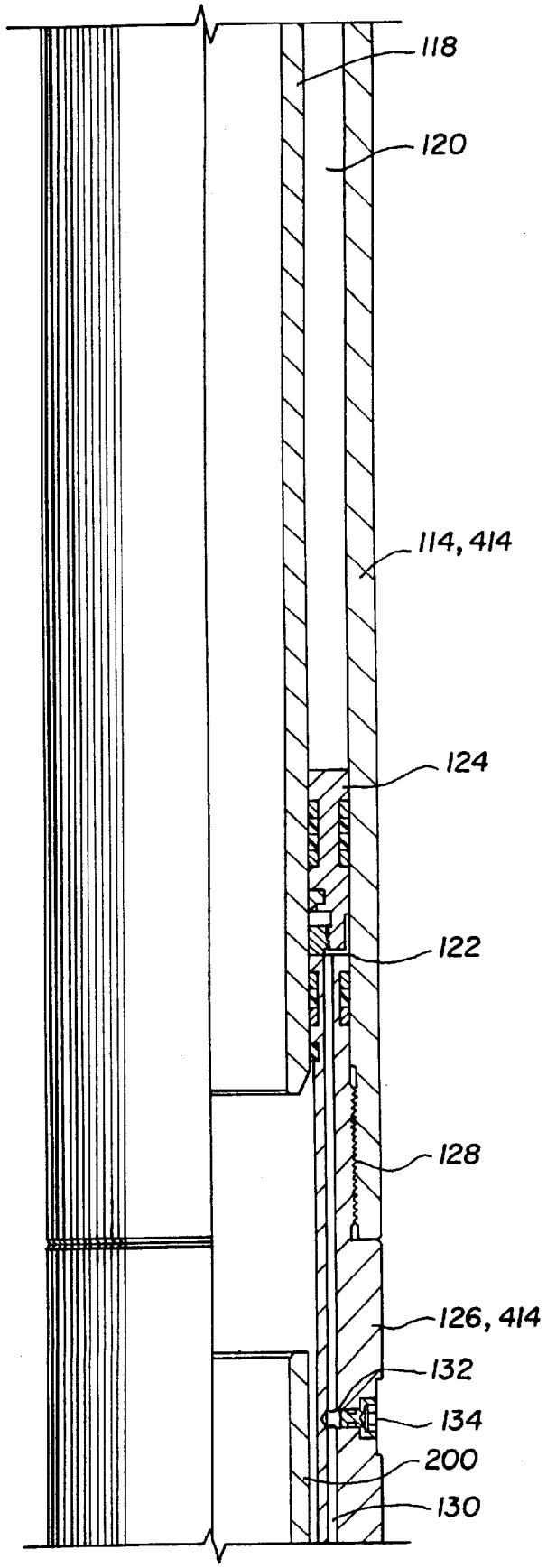
Figure 2C:
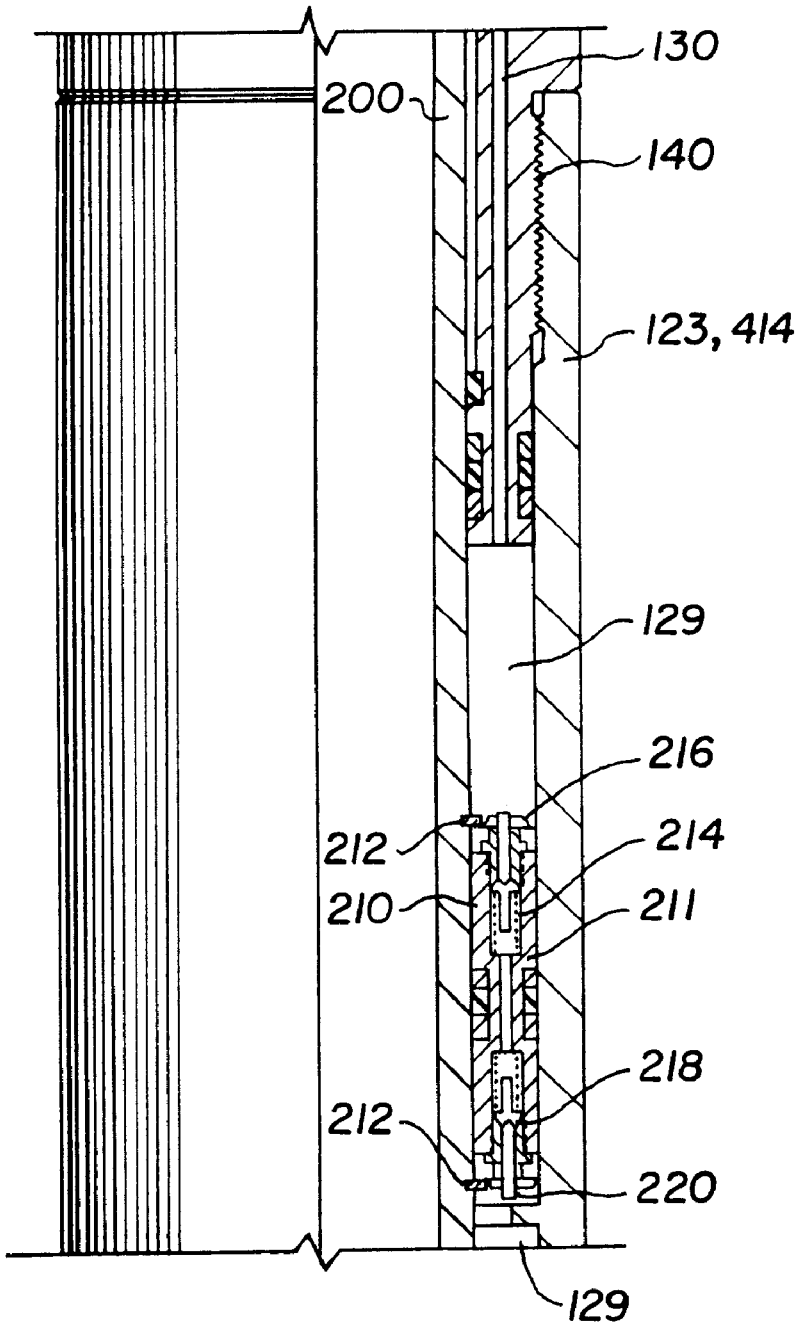
Figure 2D:
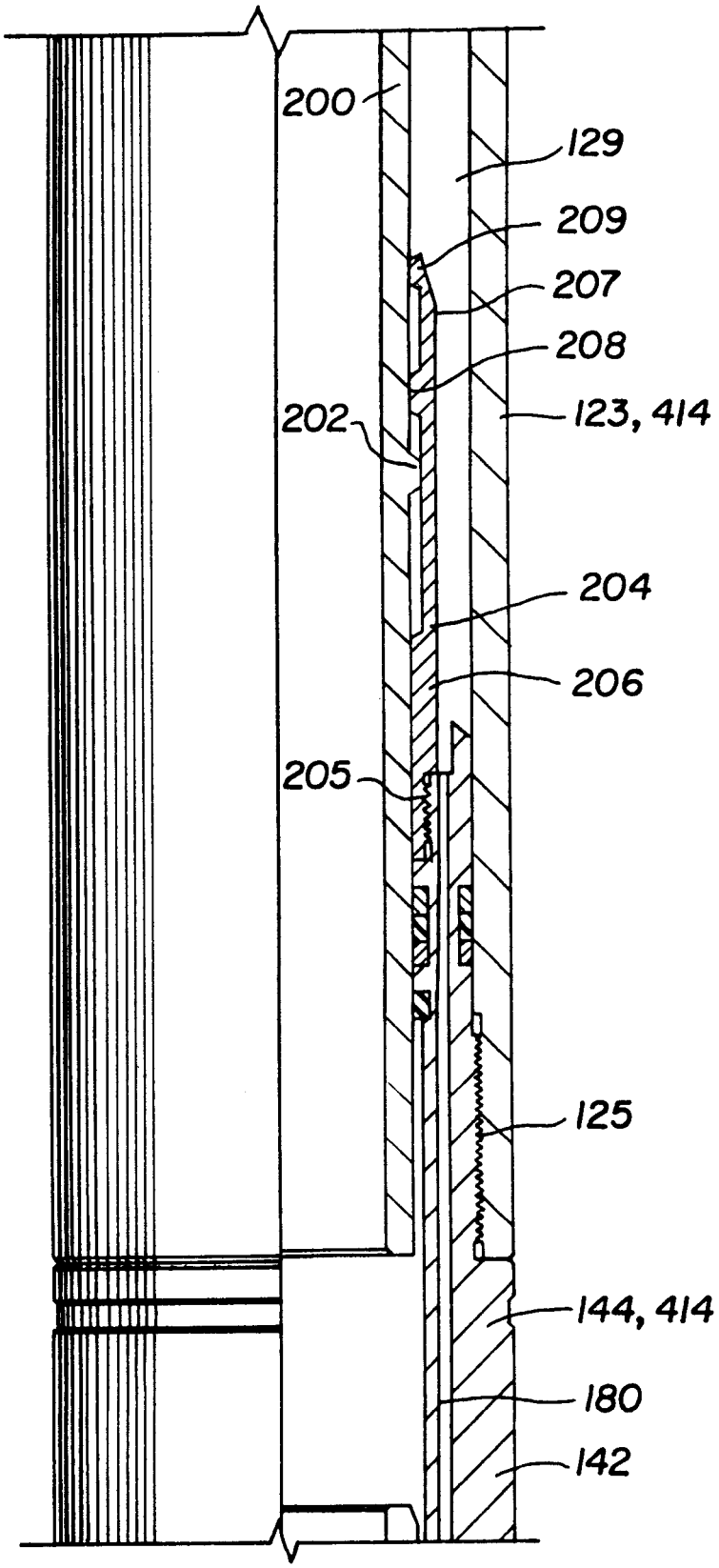
Figure 2E:
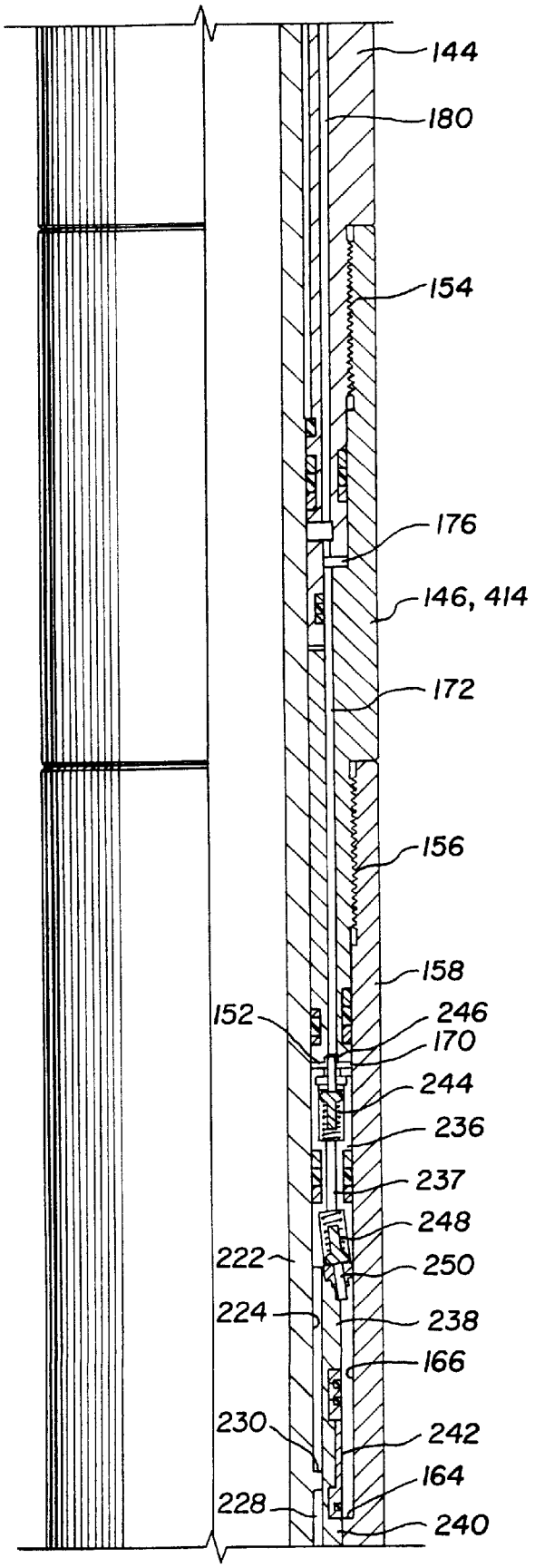
Figure 2F:
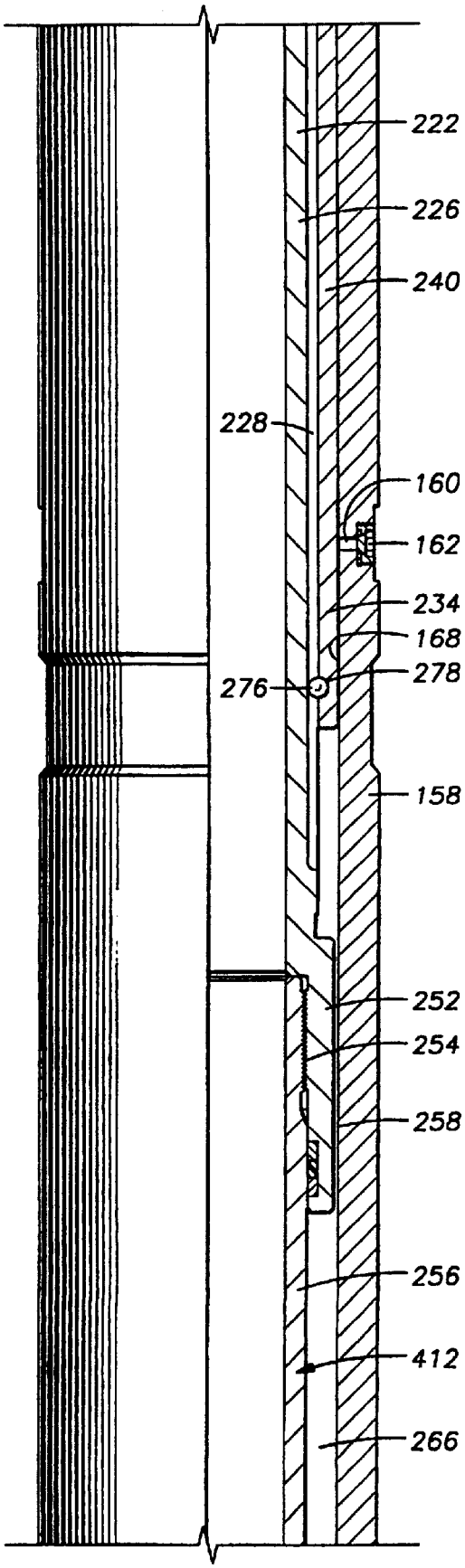
Figure 2G:
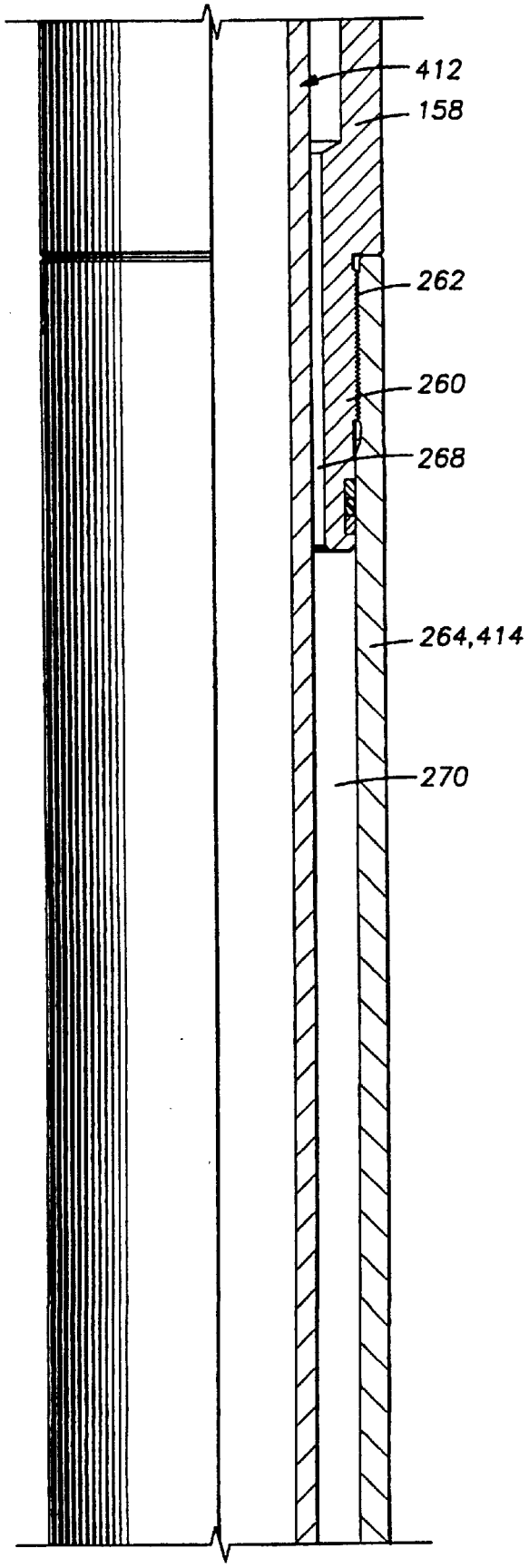
Figure 2H:
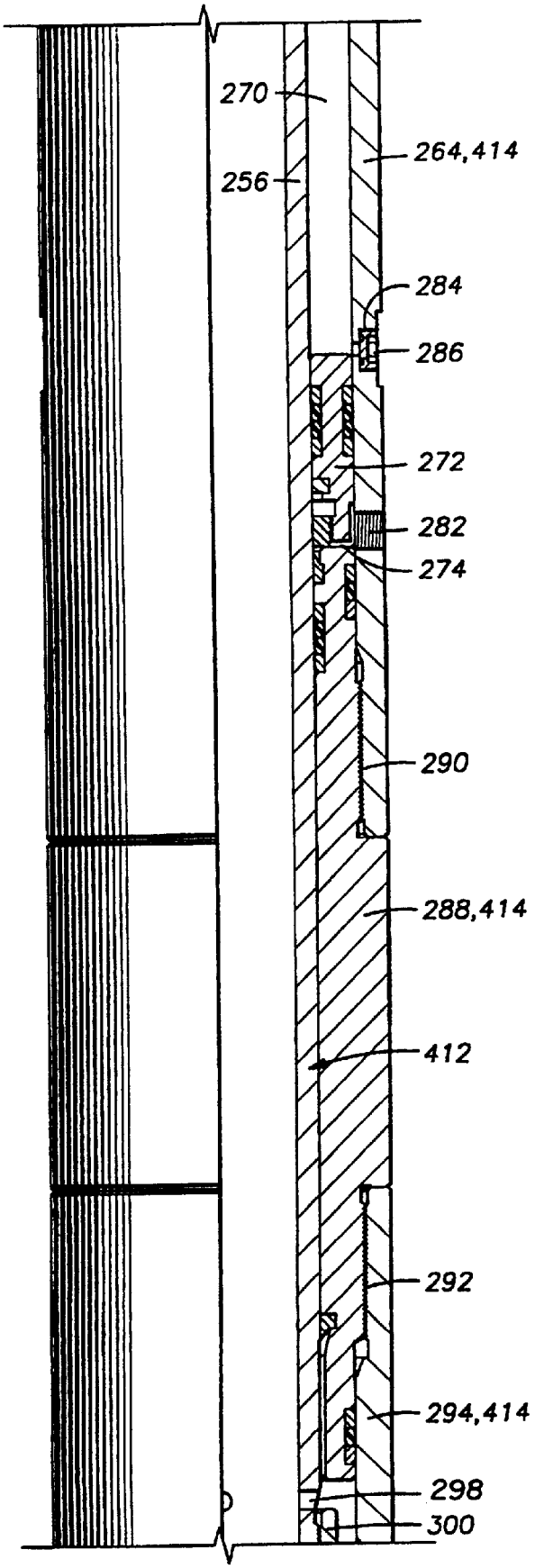
Figure 21:
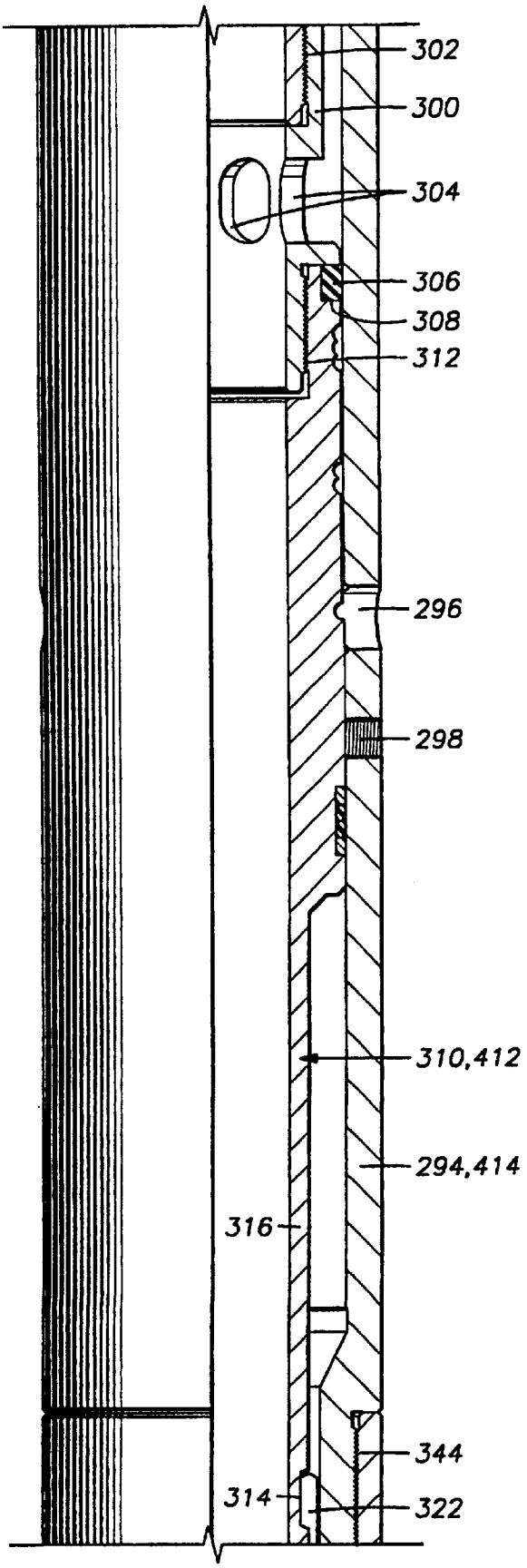
Figure 5:
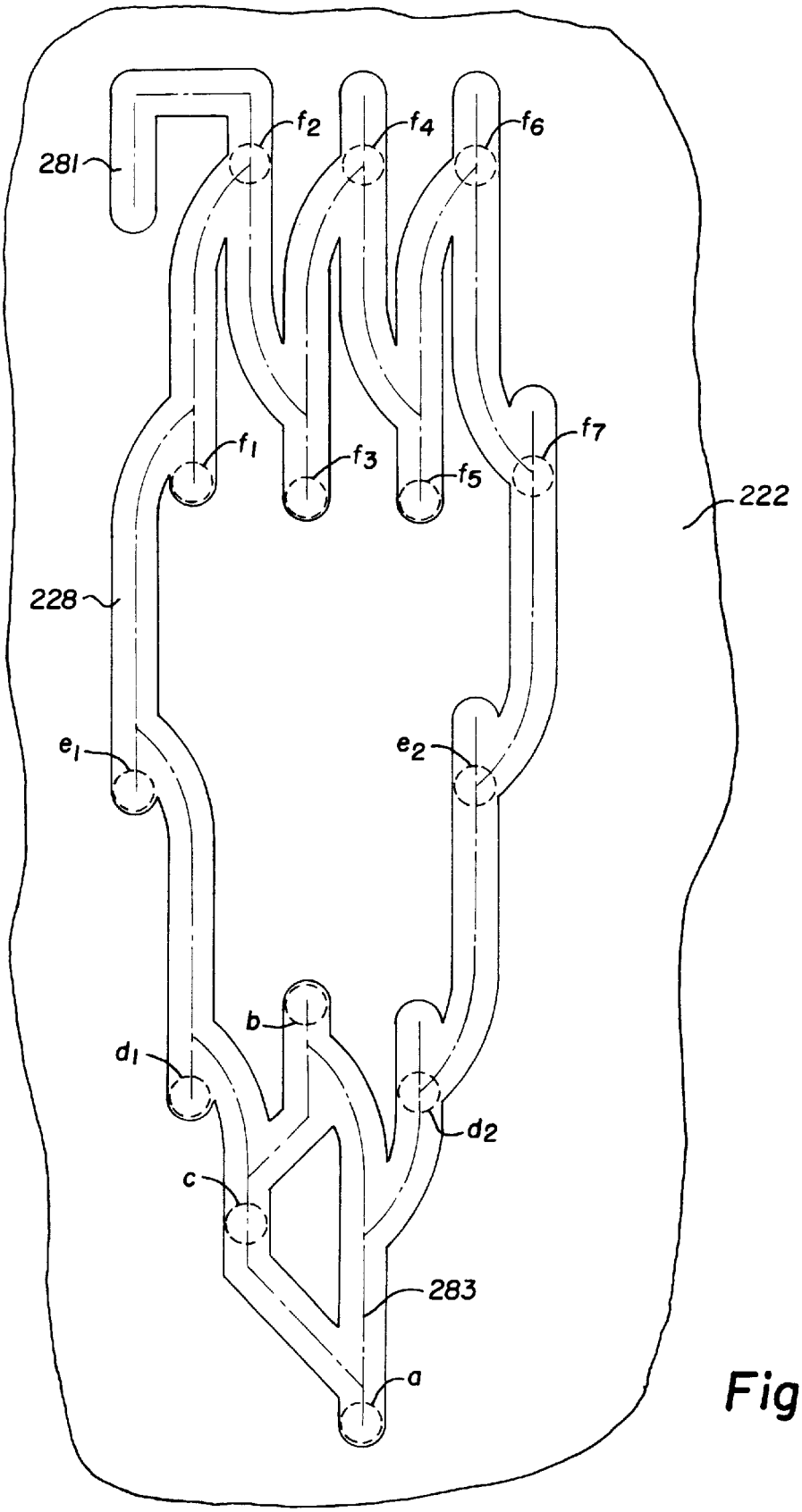
FIG. 5 illustrates a preferred slot design for a tool constructed in accordance with the present invention.
Figure 6:
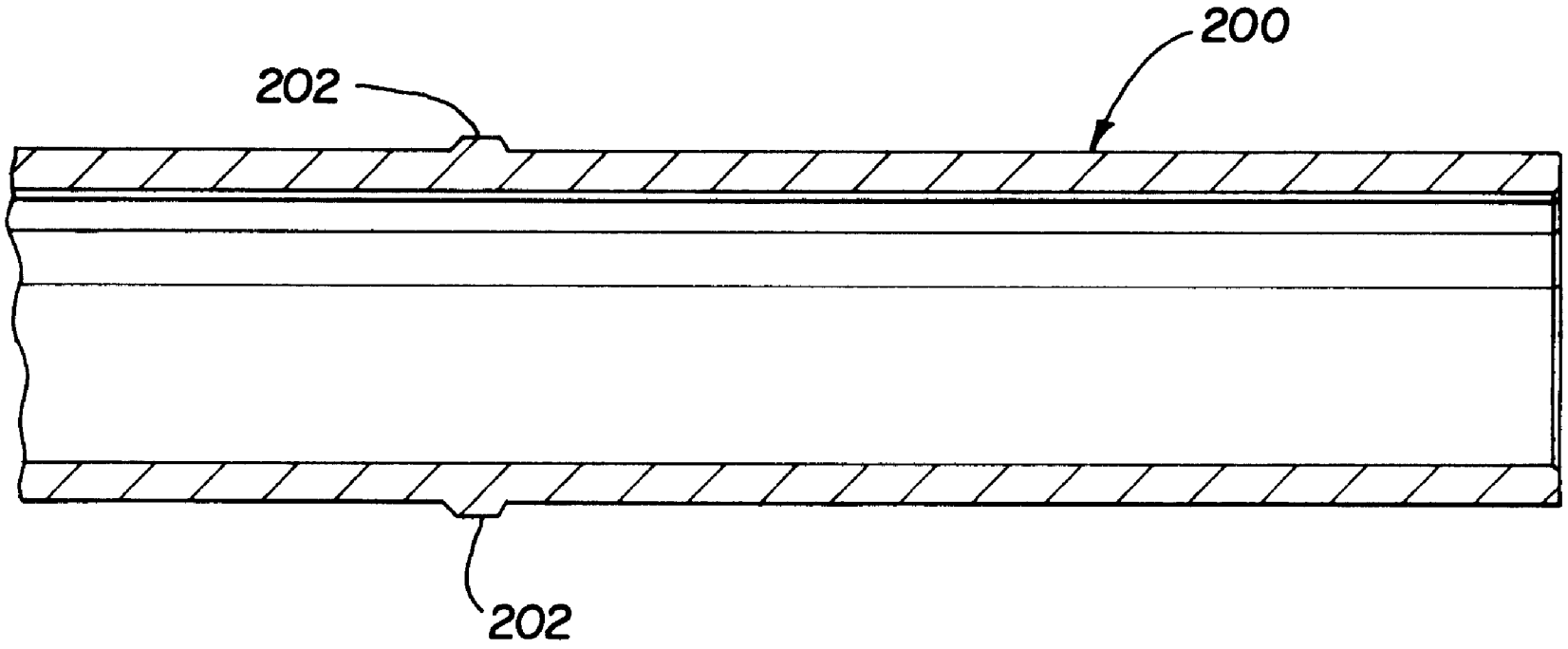
FIG. 6 is a section view of the latching mandrel employed in the exemplary tool of FIG. 2.
Figure 8:
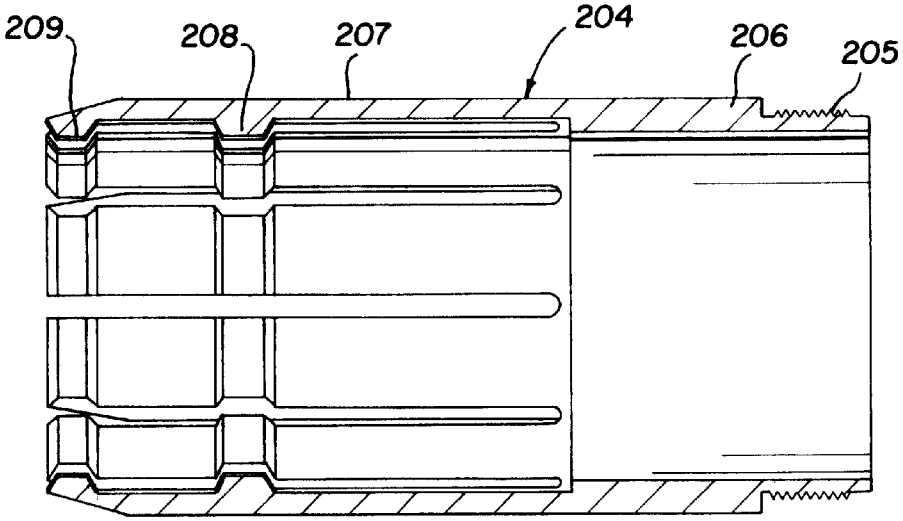
FIG. 8 is a section view of the double collet taken along line A—A of FIG. 7.
Figure 9:
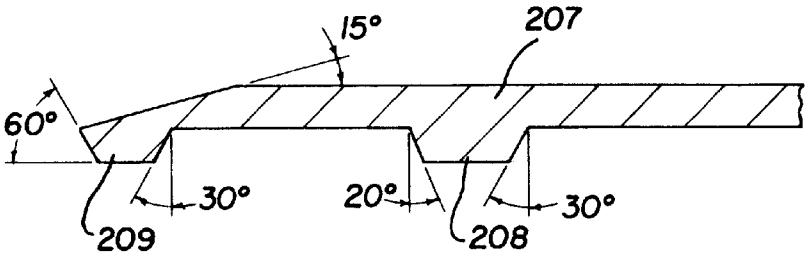
FIG. 9 is a detail of one of the double collet fingers of the double collet shown in FIG. 7.
Figure 7:
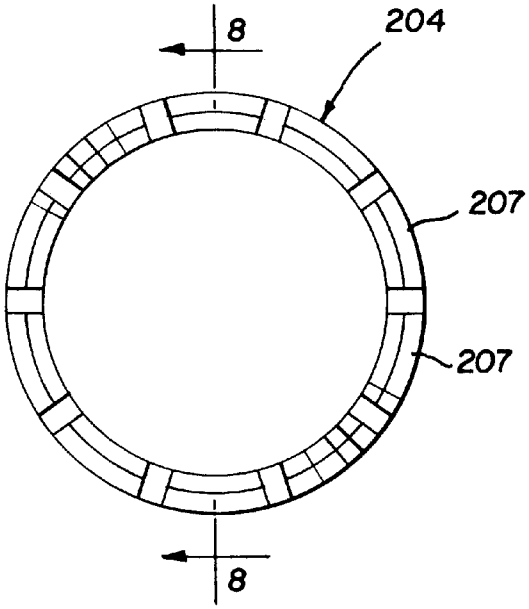
FIG. 7 is an end view looking downward onto the double collet employed in the exemplary tool of FIG. 2.

Referring now to FIGS. 2F and 5, two ratchet balls 276 are found in ball seats 278 located on diametrically opposite sides of lower sleeve 240 and each project into a ratchet slot 228 of semi-circular cross-section. The configuration of ratchet slot 228 is shown in FIG. 5. As shown there, the ratchet slot 228 includes an installation groove 281 which has a depth greater than that of the ratchet slot 228 to permit the introduction and capture of balls 276 during assembly of the tool 50. The ratchet slot 228 includes a unique pattern or configuration having a number of ball positions, a, b, c, d sub 1, d sub 2, e sub 1, e sub 2, f sub 1, f sub 2, f sub 3, f sub 4, f sub 5, f sub 6 and f sub 7 which are shown in phantom in FIG. 5. The ball positions correspond to the general positions for balls 276 along ratchet slot 228 during the various operations involving annulus pressurization changes. As the balls 276 follow the path of slot 228, lower sleeve 240 rotates with respect to upper sleeve 238, and axial movement of the ball sleeve assembly 234 is transmitted to ratchet slot mandrel 222 by balls 276.

Fluid Circulating Assembly

Referring again to FIG. 2, the lower end of extension case 264 includes oil fill ports 284 containing closing plugs 286. A nipple 288 is threaded at 290 at its upper end to extension case 264 and at 292 at its lower end to circulation displacement housing 294. The circulation displacement housing 294 possesses a plurality of circumferentially spaced, radially extending circulation ports 296, as well as one or more pressure equalization ports 298, extending through the wall thereof. A circulation valve sleeve 300 is threaded to the lower end of extension mandrel 256 at threaded connection 302. Valve apertures 304 extend through the wall of circulation valve sleeve 300 and are isolated from circulation ports 296 by annular seal 306, which is disposed in seal recess 308 formed by the junction of circulation valve sleeve 300 and a lower operating mandrel 310, the two being threaded together at 312.

Valve Ball Assembly

Operating mandrel 310 includes a reduced diameter, downwardly extending skirt 316 having an exterior annular recess 314. A collet sleeve 318, having collet fingers 320 at its upper end extending upwardly therefrom, engages the downwardly extending skirt 316 of operating mandrel 310 through the accommodation of radially, inwardly extending protuberances 322 received by annular recess 314. As is readily noted in FIGS. 2I–2J, protuberances 322 and the upper portions of collet fingers 320 are confined between the exterior of mandrel 310 and the interior of circulation displacement housing 294 thereby maintaining the connection.

Collet sleeve 318 includes coupling 324 at its lower end comprising radially extending flanges 326 and 328, forming an exterior annular recess 330 therebetween. A lower coupling 332 comprises inwardly extending flanges 334 and 336 forming an interior recess 338 therebetween and two ball operating arms 338. Couplings 324 and 332 are maintained in engagement by their location in annular recess 340 between ball case 342, which is threaded at 344 to circulation-displacement housing 294, and ball housing 346. Ball housing 346 is of substantially tubular configuration, having an upper smaller diameter portion 348 and a lower, larger diameter portion 350. Larger diameter portion 350 has two windows 352 cut through the wall thereof to accommodate the inward protrusion of lugs 354 on each of the two ball operating arms 338. Windows 352 extend from shoulder 356 downward to shoulder 358 adjacent threaded connection 360 with ball support 362. On the exterior of the ball housing 346, two longitudinal channels (location shown by phantom arrow 364) of arcuate cross-section and circumferentially aligned with windows 352, extend from shoulder 366 downward to shoulder 356. Ball operating arms 338, which are of substantially the same arcuate cross section as channels 364 and lower portion 350 of ball housing 346, lie in channels 364 and across windows 352, and are maintained in place by the interior wall 368 of ball case 342 and the exterior of portion 350 of ball housing 346.

The interior of ball housing 346 possesses upper annular seat recess 370, within which annular ball seat 372 is disposed, being biased downwardly against valve ball 374 by ring spring 376. Surface 378 of upper seat 372 comprises a metal sealing surface, which provides a sliding seal with the exterior 380 of valve ball 374.

Valve ball 374 includes a diametrical bore 382 therethrough of substantially the same diameter as bore 384 of ball housing 346. Two lug recesses 386 extend from the exterior 380 of valve ball 374 to bore 382.

The upper end 388 of ball support 362 extends into ball housing 346, and carries lower ball recess 390 in which annular lower ball seat 392 is disposed. Lower ball seat 392 possesses arcuate metal sealing surface 394 which slidingly seals against the exterior 380 of valve ball 374. When ball housing 346 is made lap with ball support 362, upper and lower ball seats 372 and 392 are biased into sealing engagement with valve ball 374 by spring 376.

Exterior annular shoulder 396 on ball support 362 is contacted by the upper ends 398 of splines 400 on the exterior of ball case 342, whereby the assembly of ball housing 346, ball operating arms 338, valve ball 374, ball seats 372 and 392 and spring 376 are maintained in position inside of ball case 342. Splines 400 engage splines 402 on the exterior of ball support 362, and, thus, rotation of the ball support 362 and ball housing 346 within ball case 342 is prevented.

Lower adaptor 404 protrudes at its upper end 406 between ball case 342 and ball support 362, sealing therebetween, when made up with ball support 362 at threaded connection 408. The lower end of lower adaptor 404 carries on its exterior threads 410 for making up with portions of a test string below tool 50.

Figure 2J:
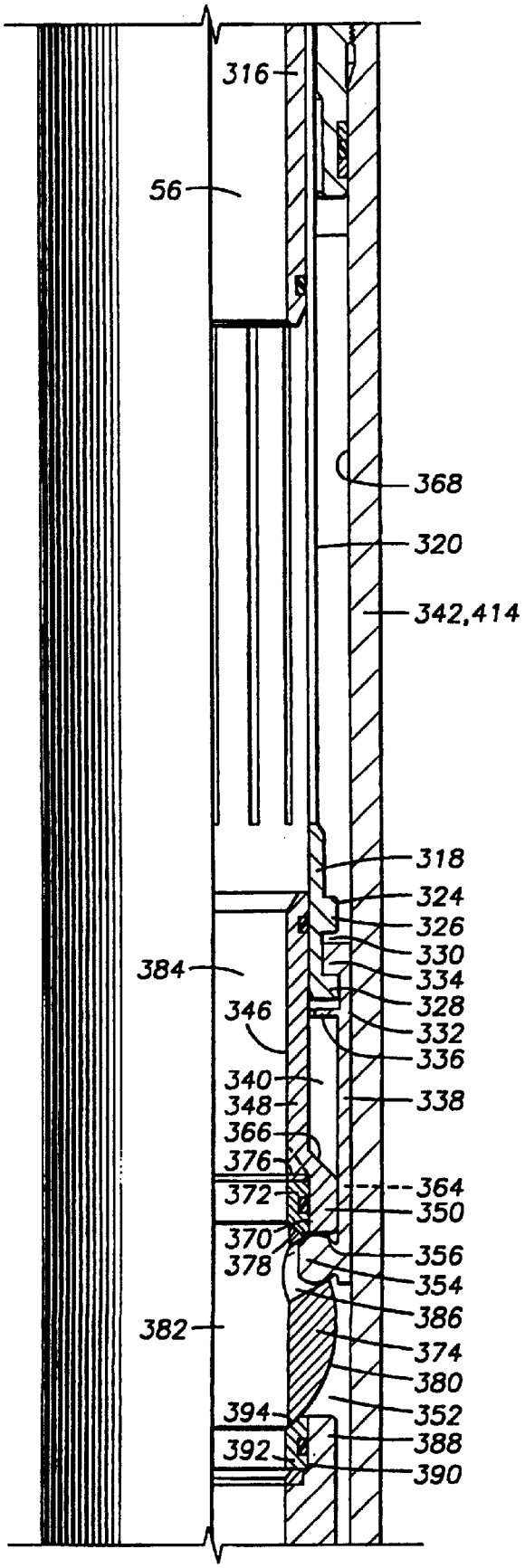
Figure 2K:
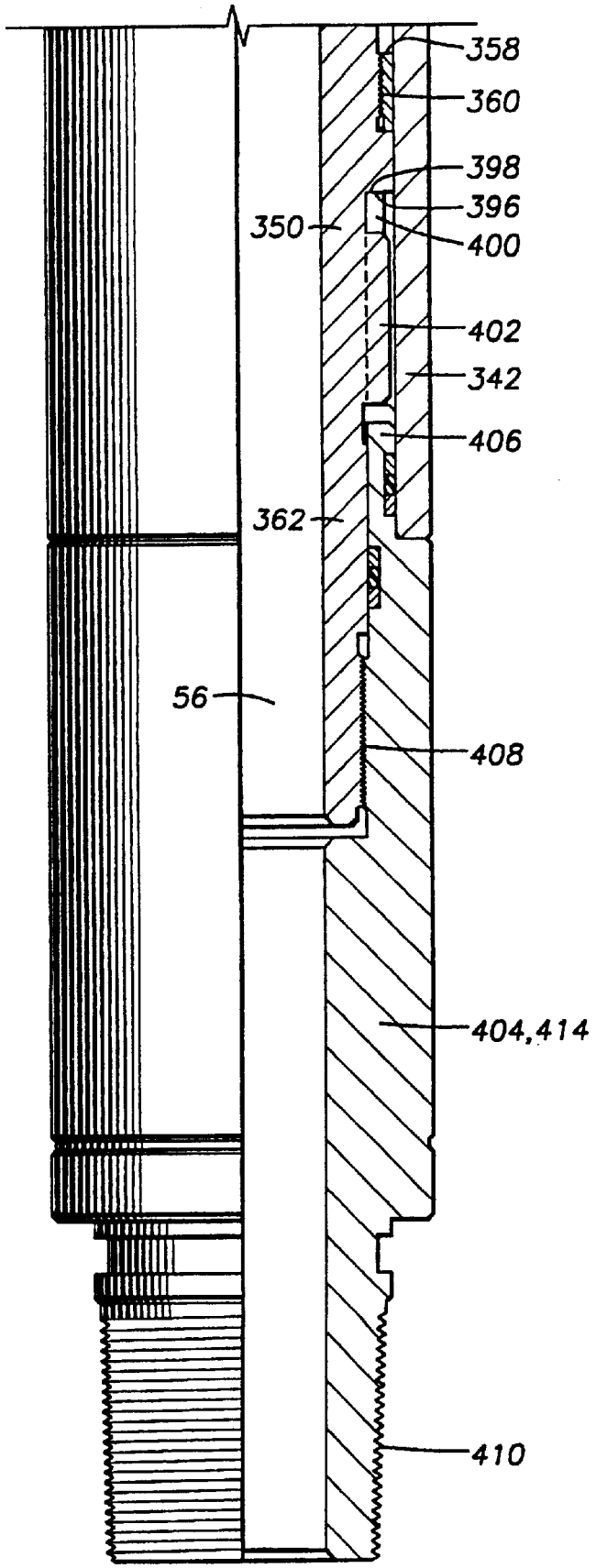
Figure 3A:
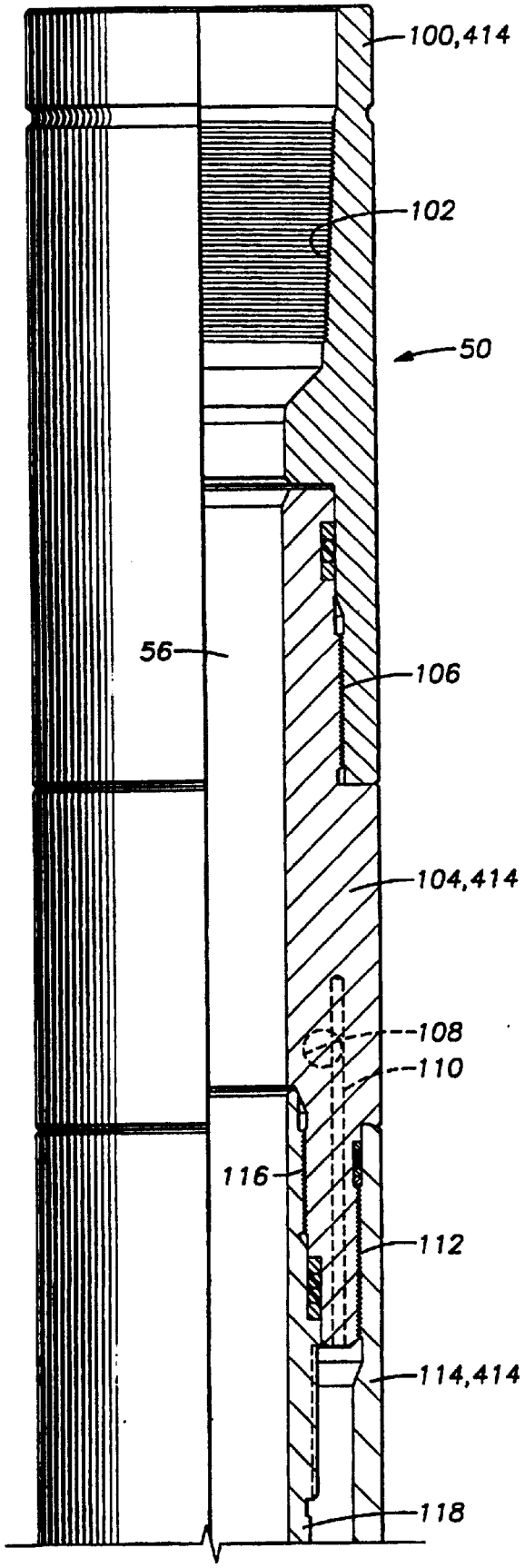
Figure 3B:
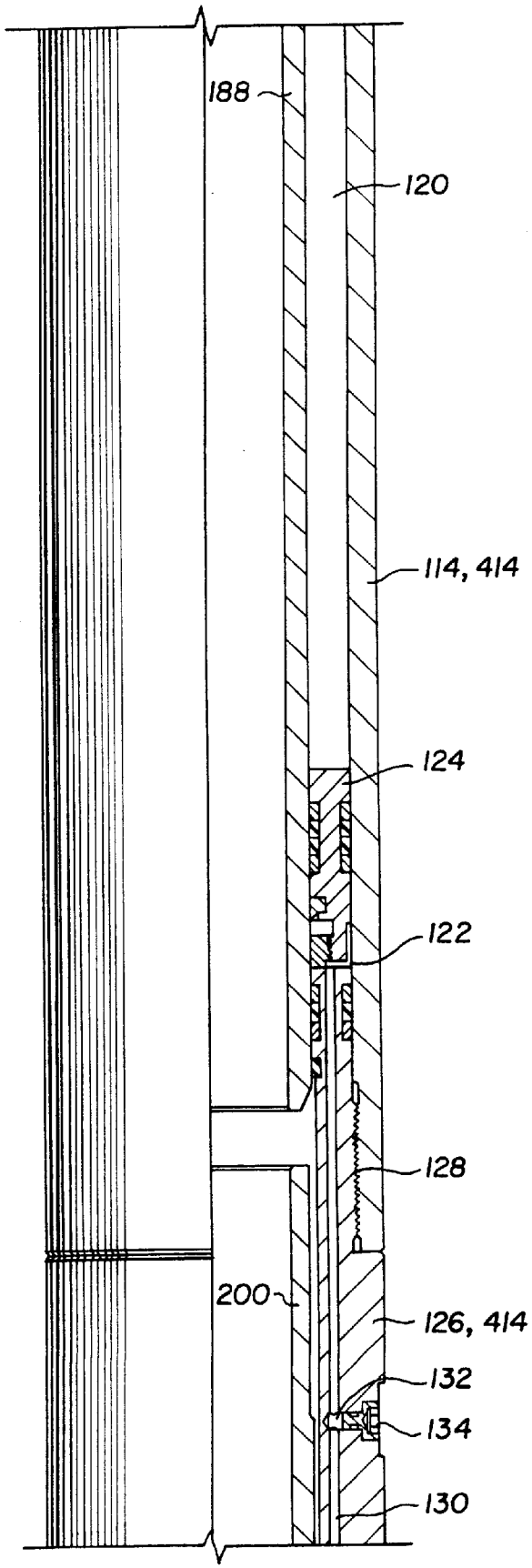
Figure 3C:
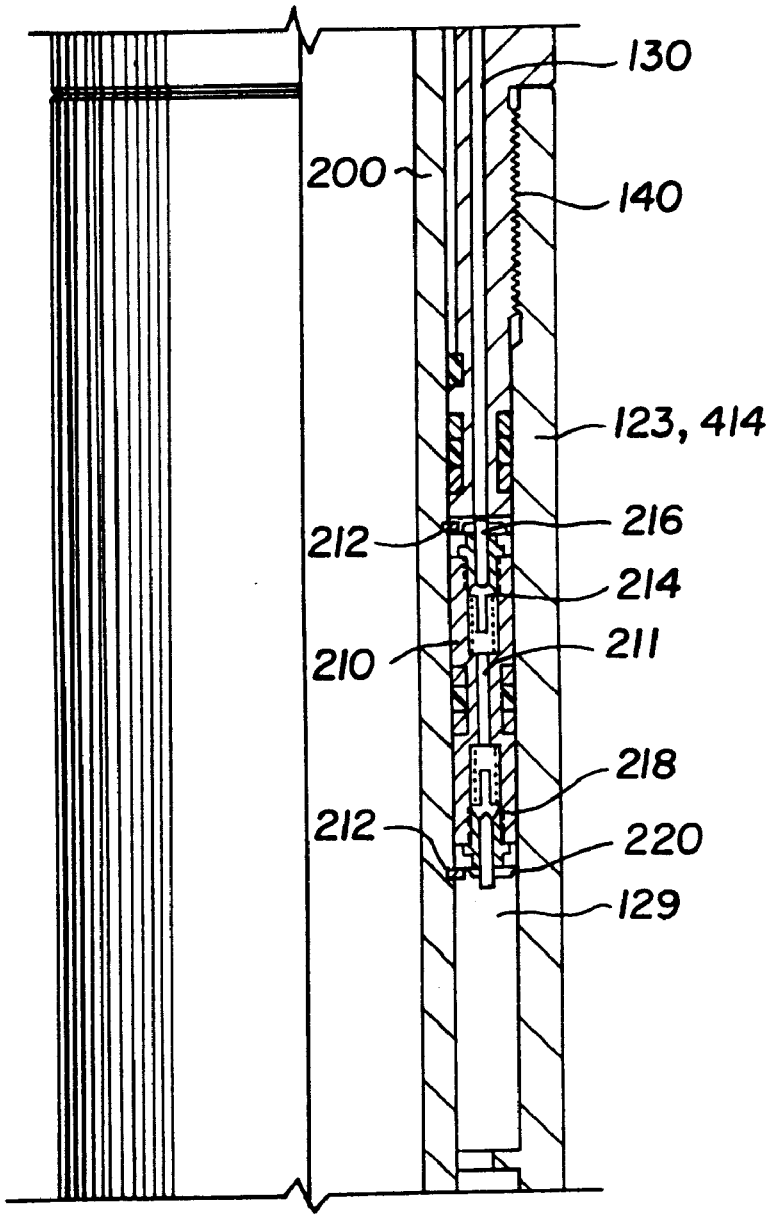
Figure 3D:
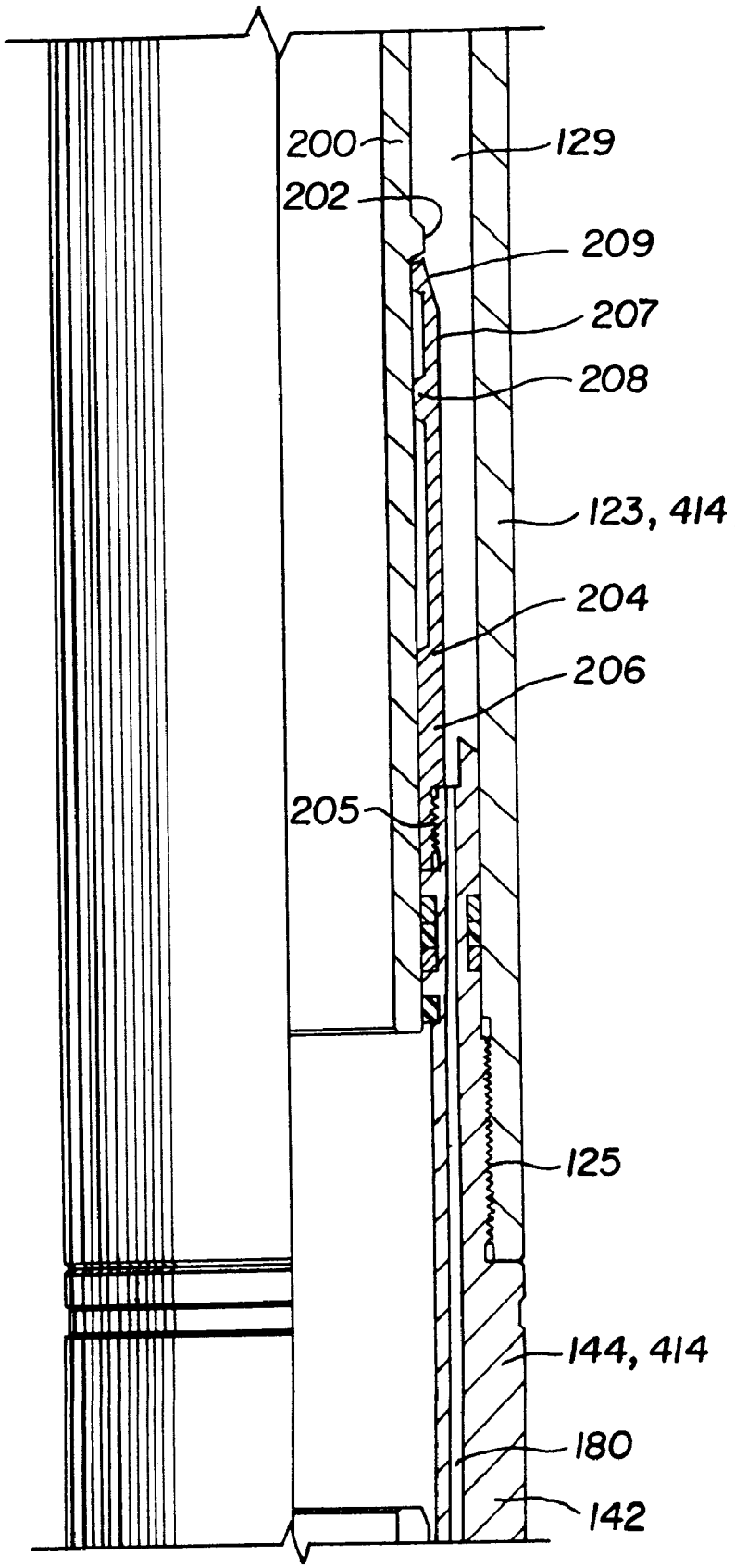
Figure 3E:
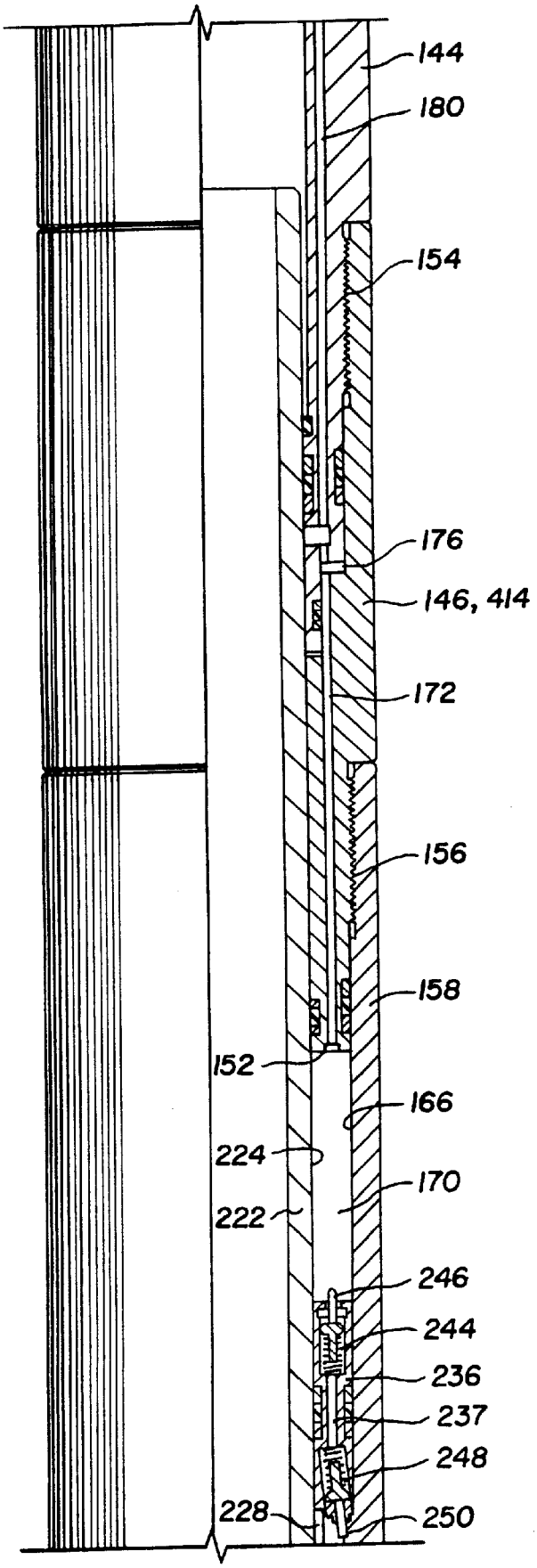
Figure 3F:
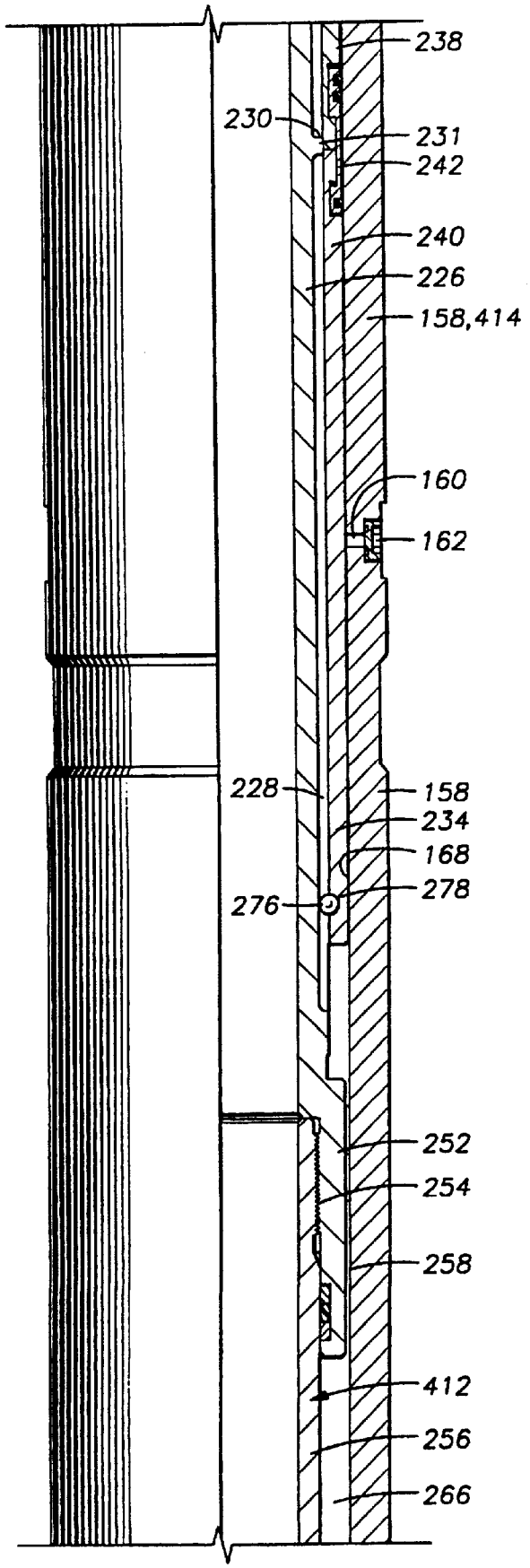
Figure 3G:
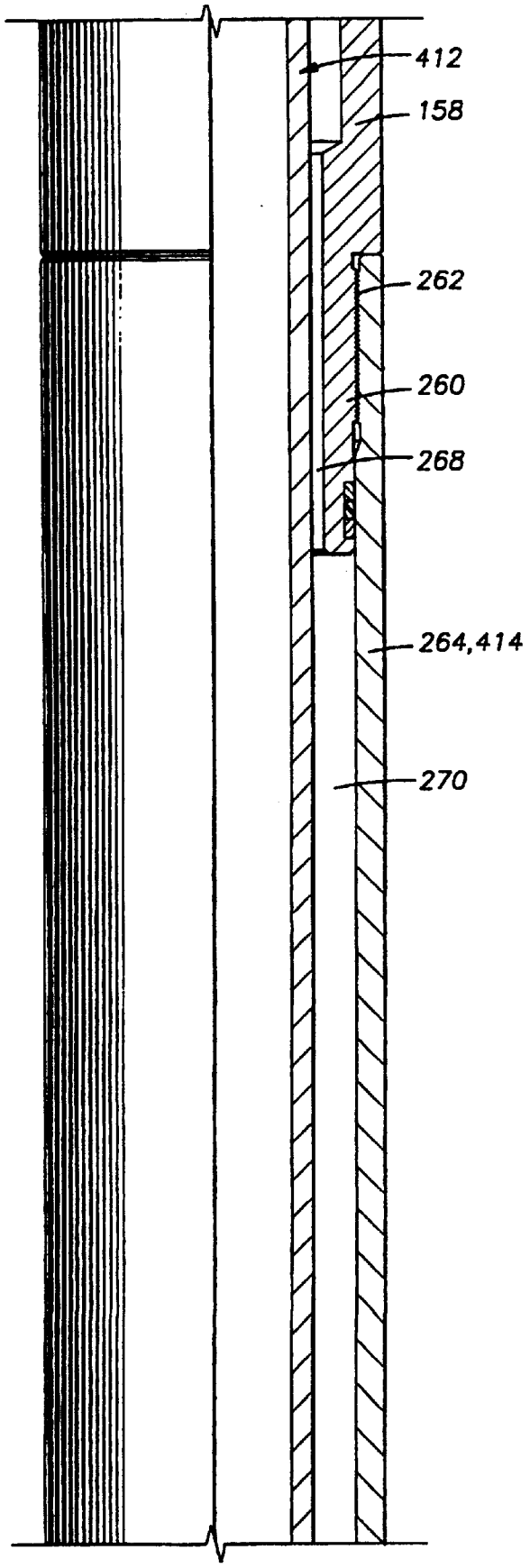
Figure 3H:
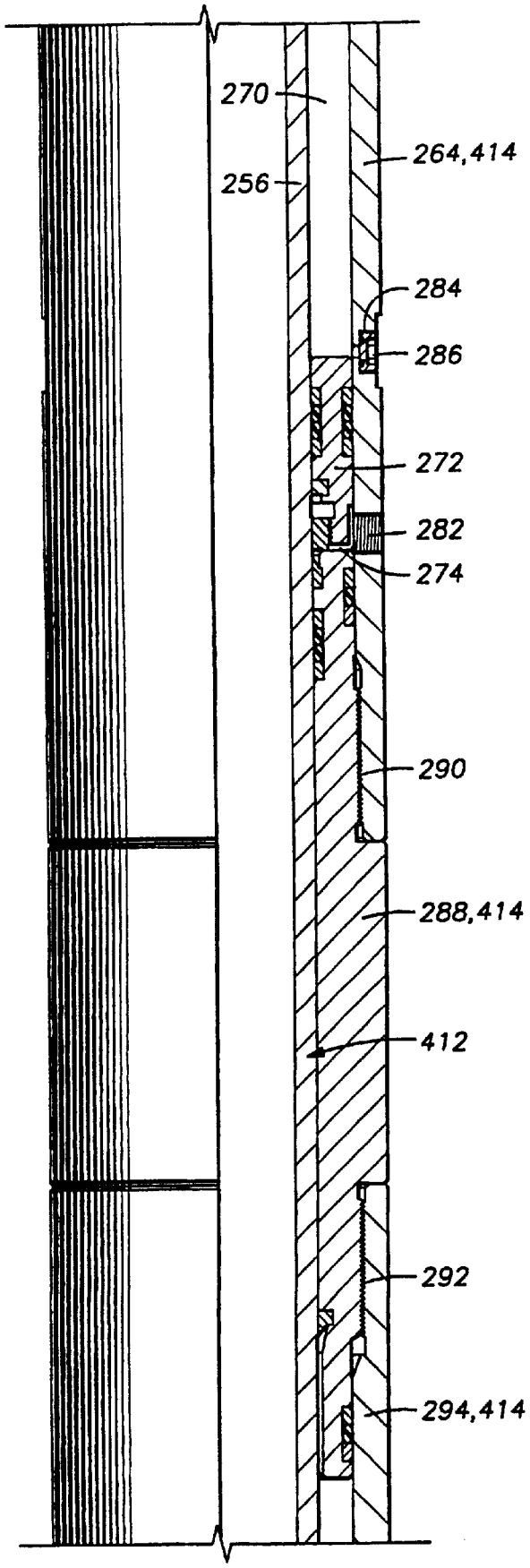
Figure 31:
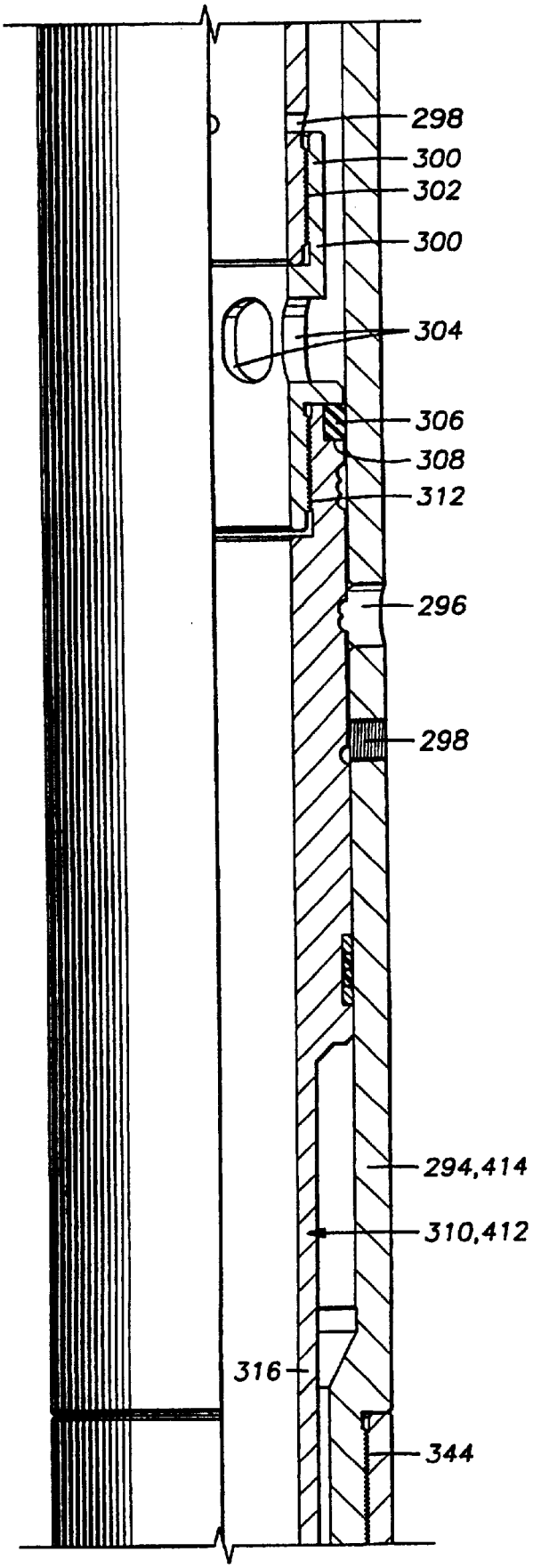
Figure 3J:
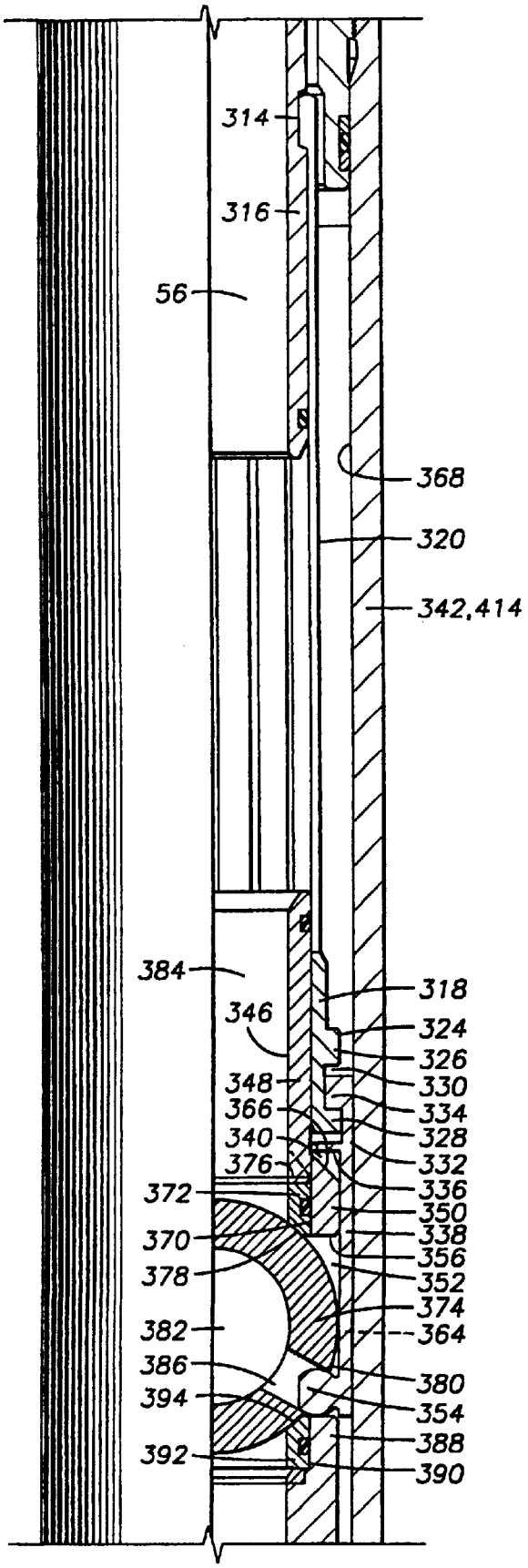
Figure 3K:
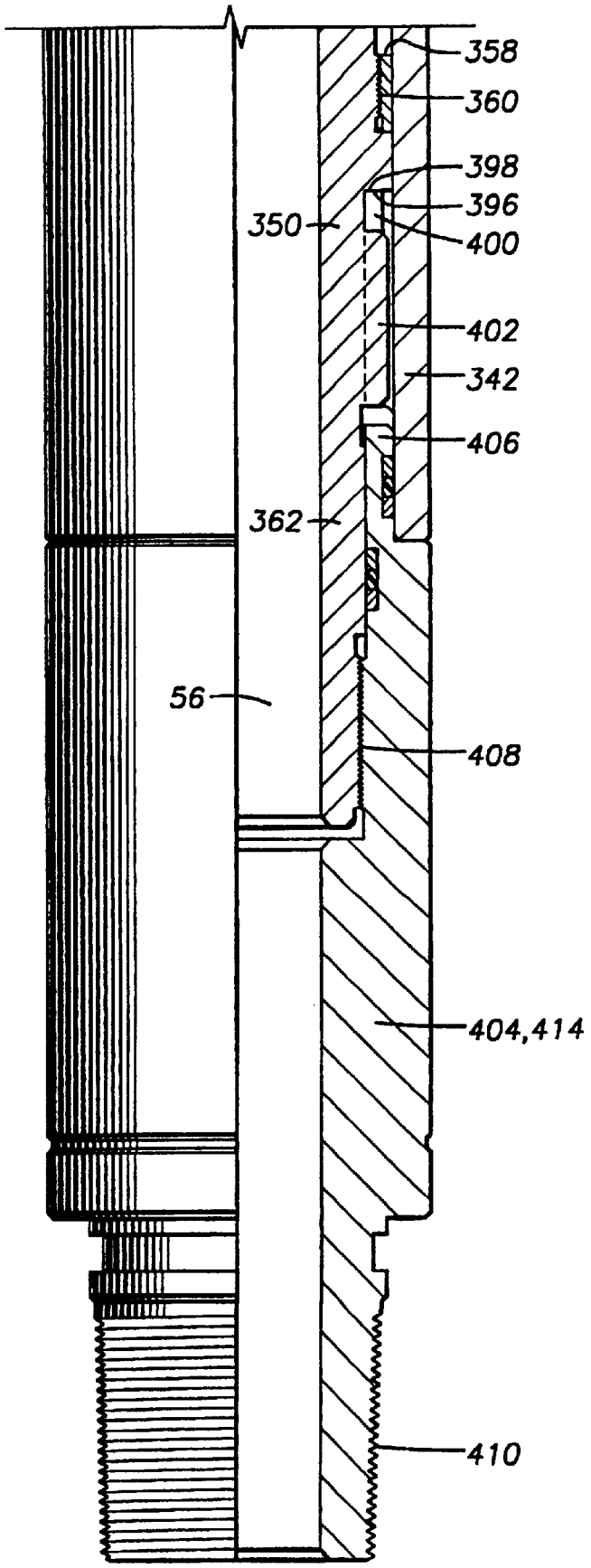
Figure 41:
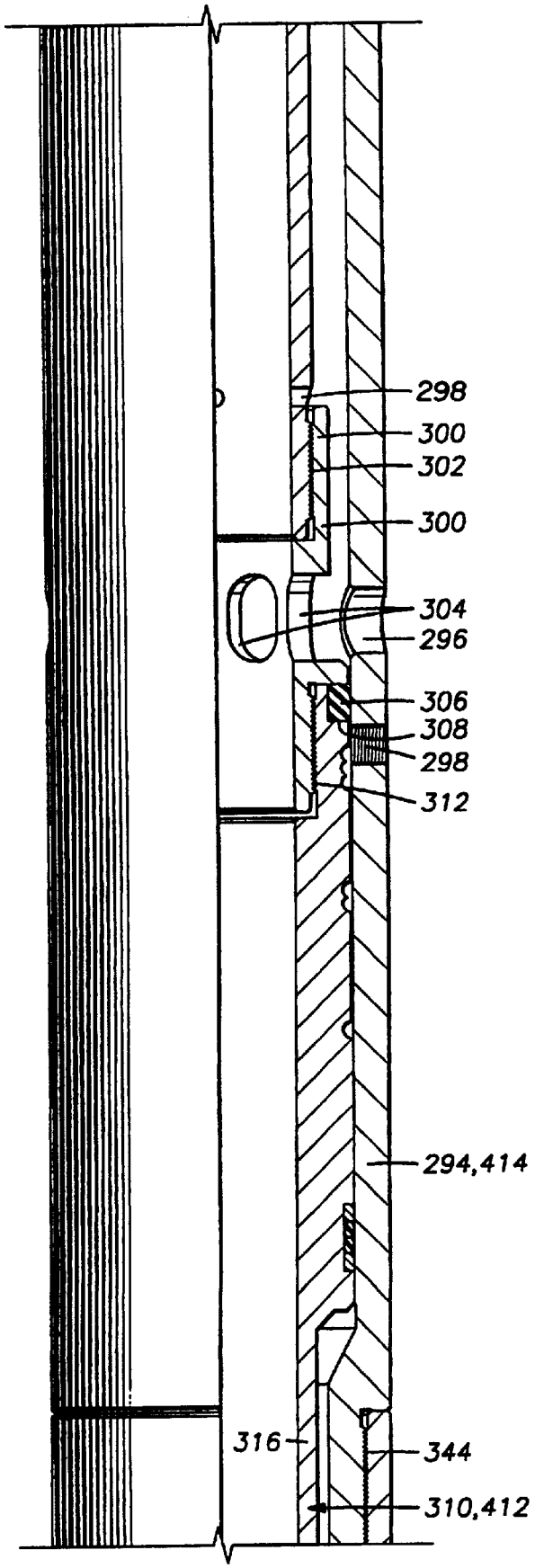

When valve ball 374 is in its open position, as shown in FIG. 2J, a "full open" conducting passage 56 extends throughout tool 50, providing an unimpeded path for formation fluids and/or for perforating guns, wireline instrumentation, etc.

Housing and Assemblies

It is noted that an exterior housing 414 for the tool 50 can be thought of as including upper adapter 100, nitrogen valve housing 104, pressure case 114, oil channel coupling 126, connector housing 123, upper and lower fluid flow housings 144 and 146, ratchet case 158, extension case 264, nipple 288, circulation displacement housing 294, ball case 342 and lower adaptor 404.

A pressure conducting channel capable of receiving, storing and releasing pressure increases can be formed, for example, by pressure ports 282, lower fluid chamber 274 and floating piston 272, lower oil chamber 270, lower oil channels 268, second intermediate oil chamber 266, slots 228, ratchet chamber 170 and shuttle piston 236, longitudinal passages 172 and 180, first intermediate oil chamber 129 and annular piston 210, longitudinal oil channels 130, and upper oil chamber 122.

A fluid spring assembly can include, for example, pressurized gas chamber 120, and floating piston 124. The spring assembly stores potential energy in response to an increase in fluid pressure within the pressure conducting channel and releases the stored potential energy into the pressure conducting channel in response to a decrease in fluid pressure within the pressure conducting channel.

A staged latching assembly can include, for example, latching mandrel 200 and double collet 204. The staged latching assembly is operatively connected to the fluid spring assembly.

A fluid circulating assembly 416 can include, for example, the circulation valve sleeve 300, valve apertures 304, annular seal 306, circulation displacement housing 294 and circulation ports 296. The fluid circulating assembly 416 can be selectively opened and closed to permit fluid flow between the annulus 46 and the central flow conducting passage 56 of the tool 50.

A valve assembly can include, for example, collet sleeve 318 and collet fingers 320, ball operating arms 338, ball housing 346, and valve ball 374. The valve assembly can be selectively opened and closed to permit fluid flow through the central flow conducting passage 56 of the well tool 50.

An operating mandrel assembly 412 can be, for example, the ratchet slot mandrel 222, extension mandrel 256, and operating mandrel 310 (the mandrel 310 being connected to the extension mandrel through the valve sleeve 300). The operating mandrel assembly is operatively connected to the valve assembly and the fluid circulating assembly and is responsive to changes in pressure within the pressure conducting channel.

A position controller can be thought of as including, for example, the rachet case 158, the rachet slots 228 in the rachet slot mandrel 222, balls 276, and the ball sleeve assembly 234, (the ball sleeve assembly further including the shuttle piston 236, upper sleeve and lower sleeves 238 and 240, and clamp 242).

It is to be understood, of course, that the housing, pressure conducting channel, and the various assemblies cooperate in a complex and interrelated manner to form a pressure responsive tool, such that elements of one assembly can also be part of another assembly.

Operation of the Preferred Embodiment

Referring to FIGS. 1–5, operation of the combination tool 50 of the present invention is described hereafter.

As tool 50 is run into the well in testing string 30, it is normally in its well test mode as shown in FIG. 2, with valve ball 374 in its open position and ball bore 382 aligned with tool bore 384. Circulation ports 296 are misaligned with circulation valve apertures 304, seal 306 preventing communication therebetween. With respect to FIG. 5, balls 276 will be proximately in position a in slot 228 as tool 50 is run into the well bore.

Maintaining Tool 50 in the Well Test Position During Changes in Annulus Pressurization An operating can selectively increase pressure in annulus 46 by pump 24 via control conduit 26. This increase in pressure is transmitted through pressure ports 282 (FIG. 2H) into fluid chamber 274, where it acts upon the lower side of floating piston 272. Piston 272, in turn, acts upon a fluid, such as silicon oil, in lower chamber 270, which communicates via oil channels 268 with second intermediate oil chamber 266. Fluid pressure in the second intermediate oil chamber 266 flows around the lower end 252 of the ratchet slot mandrel 222 and through slots 228 to exert upward fluid pressure upon the shuttle piston 236 which pulls ball sleeve assembly 234. Balls 276 move along slot 228 to position b. Via the association of the ratchet slot mandrel 222 and ball sleeve assembly 234, the ratchet slot mandrel 222 and the entire operating mandrel assembly 412 may be moved upward slightly but not a sufficient amount to affect either the valve ball 374 or the circulating assembly 416. Fluid within ratchet chamber 170 is evacuated upward through the fluid flow housing 142 and longitudinal passages 172 and 180 into first intermediate oil chamber 129. The increased pressure drives annular piston 210 and the affixed latching mandrel 200 axially upward, with the lug 202 on the latching mandrel 200 slipping past first knuckle 208 and second knuckle 209 on the double collet 204 to the position shown in FIGS. 3B–D. Fluid above the piston 210 is evacuated upward from the first intermediate oil chamber 129 through longitudinal channels 130 into upper oil chamber 122 to urge floating piston 124 upward, thereby pressurizing the gas in chamber 120 to store the pressure increase.

As annulus pressure is subsequently bled off during depressurization, the pressurized nitrogen in chamber 120 pushes downward against floating piston 124. This pressure is transmitted through fluid within upper oil chamber 122, channels 130 and first intermediate oil chamber 129. Annular piston 210 and the affixed latching mandrel 200 are moved axially downward. Fluid from first intermediate oil chamber 129 below the piston 210 is transmitted downward through the fluid flow housing 142 and longitudinal passages 180 and 172 into the ratchet chamber 170. Ball sleeve assembly 234 is, therefore, biased downwardly with rachet balls 276 following the paths of slot 228 from position b back toward position a. However, the lug 202 on latching mandrel 200 slips past the second knuckle 209 on the double collet 204 to engage the first knuckle 208 at an intermediate stage pressure position shown in FIGS. 4B–D, whereby only part of the stored potential energy of the pressurized nitrogen chamber is released. This limited movement corresponds to moving the ball sleeve assembly 234 downwardly such that the rachet balls stop at position c.

As more annulus pressure continues to be bled off, the pressurized nitrogen in chamber 120 becomes less and less balanced by the annulus pressure, until the pressurized nitrogen chamber 120 pushes downward against floating piston 124 with sufficient unbalanced force such that the lug 202 on latching mandrel 200 slips past the first knuckle 208, whereby the stored potential energy in the pressurized nitrogen chamber is fully released. This release of stored potential energy into the first intermediate oil chamber 129 below the piston 210 is transmitted downward through the fluid flow housing 142 and longitudinal passages 180 and 172 into the ratchet chamber 170. Ball sleeve assembly 234 is, therefore, biased downwardly with rachet balls 276 following the paths of slot 228 past position c back toward position a. Downward travel of the ball sleeve assembly 234 is limited by engagement of the shuttle piston 236 on piston seat 230 (FIG. 2E). Again, any downward movement of the ratchet slot mandrel 222 and the operating mandrel assembly 412 will be slight and not sufficient to close the valve ball 374 or close the circulating assembly 416. As a result, the ratchet assembly may be thought of as providing a default position sequence with the well test position cycle 283 wherein the operating mandrel assembly 412 is maintained during annulus pressure changes in primary mandrel positions such that the valve ball 374 and the circulating assembly 416 are not affected.

Accordingly, as tool 50 travels down to the level of the production formation 8 to be tested, at which position packer 44 is set, floating piston 272 moves upward under hydrostatic pressure, pushing ball sleeve assembly 234 upward and causing balls 276 to move toward position b. This movement does not change tool modes or open any valves. Upon tool 50 reaching formation 8, packer 44 is set. The aforesaid feature is advantageous in that it permits pressuring of the well bore annulus 46 to test the seal of packer 44 across the well bore 4 without closing valve ball 374. It also permits independent operation of other annulus pressure responsive tools within testing string 30.

Increases in annulus pressure will move floating piston 272 and ball sleeve assembly 234 further upward, its movement ultimately being restricted by the shouldering out of balls 276 at ball position b within slot 228. Reduction in annulus pressure will move floating piston 272 and ball sleeve assembly 234 downward and cause balls 276 to move downward to ball position c, and further reductions in annulus pressure will move floating piston 272 and ball sleeve assembly 234 ultimately back to ball position a. The well annulus pressure may be increased and decreased as many times as desired without moving the tool 50 out of the well test position, the balls 276 following the described well test position path 283, which is made up of the ball positions a, b and c and the paths of slot 228 connecting them. Effectively, the well test position path 283 affords default position control for the tool 50 by maintaining the tool 50 in its well test position during regular annulus pressurization cycles.

Changing the Tool 50 Out of The Well Test Position Using Partial Changes in Annulus Pressurization The tool 50 may be changed out of the well test position by increasing annulus pressure during the portion of the annulus pressure reduction sequence when balls 276 are at ball position c. As a result, annulus repressurization during a release of stored fluid pressure from the pressurized gas chamber 120 acts to override the default position control being provided for the operating mandrel assembly 222 by the well test position path 283.

If the operator repressurizes the annulus pressure instead of bleeding off more pressure, the annulus pressure is transmitted through pressure ports 282 (FIG. 2H) into fluid chamber 274, where it acts upon the lower side of floating piston 272. Piston 272, in turn, acts upon a fluid, such as silicon oil, in lower chamber 270, which communicates via oil channels 268 with second intermediate oil chamber 266. Fluid pressure in the second intermediate oil chamber 266 flows around the lower end 252 of the ratchet slot mandrel 222 and through slots 228 to exert upward fluid pressure upon the shuttle piston 236 which pulls ball sleeve assembly 234. Balls 276 move along slot 228 from position c upward to position d sub 1, thereby being diverted from the primary well test path a-b-c into an alternate contiguous path for controlling the position of the operating mandrel assembly. Via the association of the ratchet slot mandrel 222 and ball sleeve assembly 234, the ratchet slot mandrel 222 and the entire operating mandrel assembly 412 may be moved upward a sufficient distance to begin affecting the states of the valve ball 374 and/or the circulating assembly 416.

The staged latching assembly provides an intermediate stage position for the fluid spring, from which an operator of the well tool 50 will have the ability to selectively continue to depressurize the annulus to maintain the well tool 50 in the well test position or to repressurize the annulus to shift the tool out of the well test positioon into other modes. The operator will have more control over the tool without having to carefully time the depressurization.

It should be apparent to one skilled in the art that the ratchet slot 228 and well test position path 283 might be altered such that the balls 276 are directed out of the well test position path 283 by an annulus pressure reduction which occurs during an increase of stored fluid pressure in the pressurized gas chamber 120.

When the well bore annulus is repressured to move the tool 50 out of its well test position, the ball sleeve assembly 234 moves upward and balls 276 are moved along slot 228 from proximate ball position c to a point above ball position d sub 1. The balls 276 have now been directed out of the well test position cycle shown at 283 on FIG. 5 and into a contiguous second ratchet path made up of the remainder of slot 281 to permit the operating mandrel assembly 412 to move to alternate mandrel positions wherein the positions of the valve ball 374 and circulating assembly 416 may be changed. Upward travel of the ball sleeve assembly 234 is ultimately limited as shuttle piston 236 encounters the lower end 152 of the fluid flow assembly 142. Downward force is exerted upon the dart 246 permitting upward fluid flow past the check valve 244 and a subsequent reduction in the upward pressure differential upon the ball sleeve assembly 234. As the pressure differential is reduced, balls 276 are shouldered at ball position d sub 1.

Once the balls 276 have been located at ball position d sub 1, further reduction of the annulus pressure shifts the tool 50 into its blank position as illustrated by FIGS. 3E–3K with the valve ball 374 being moved to a closed position. The operating mandrel assembly 412 is positioned lower with respect to the ball sleeve assembly and housing 414 due to engagement of the balls 276 with the ratchet slot mandrel 222 at ball position d sub 1. The downward pressure differential upon ball sleeve assembly 234 urges it downward along with the operating mandrel assembly 412, collet sleeve 318 and ball operating arms 338 to close valve ball 374 such that its bore 382 is not aligned with the ball housing bore 384. As is apparent from FIG. 3I, however, this downward movement is not sufficient to align the circulation ports 296 with the valve apertures 304 and permit fluid communication therethrough. As a result, the circulating assembly 416 remains closed.

Figure 4A:
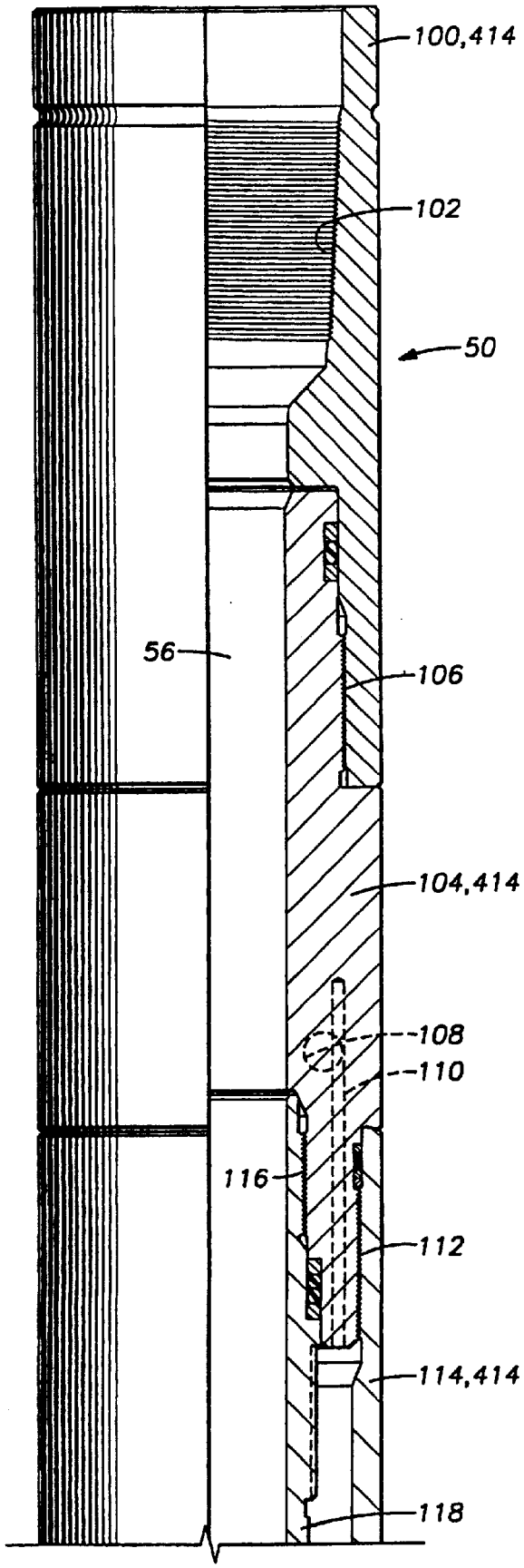
Figure 4B:
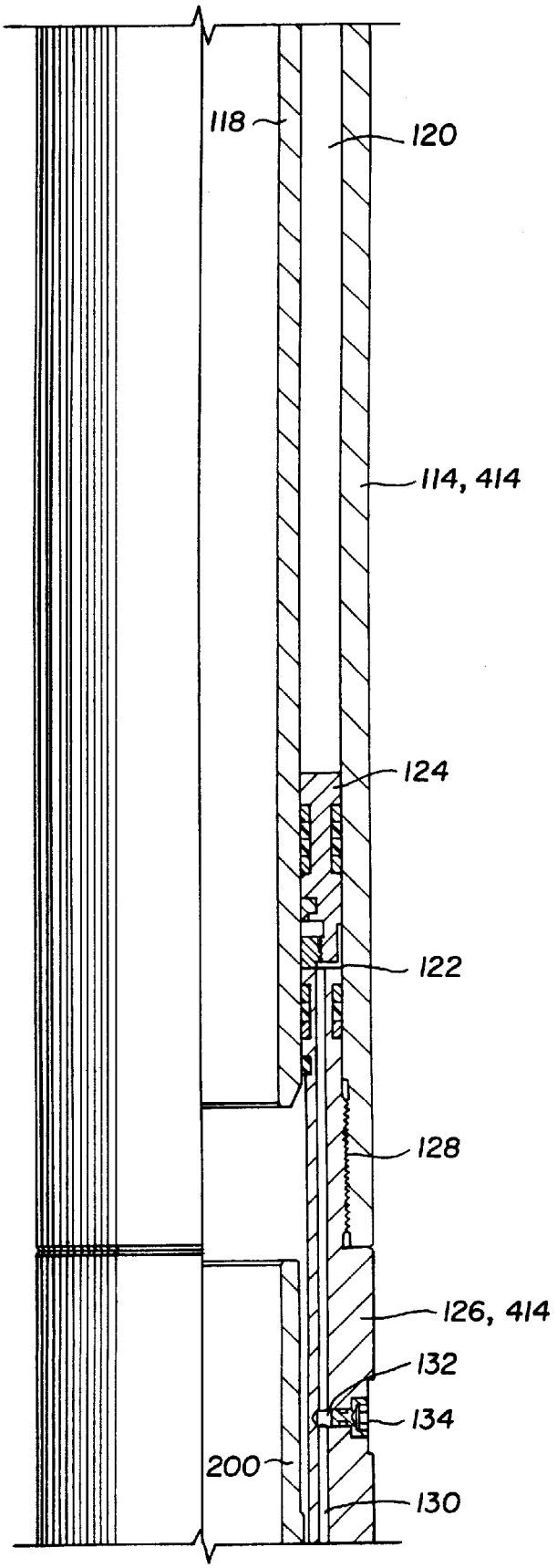
Figure 4C:
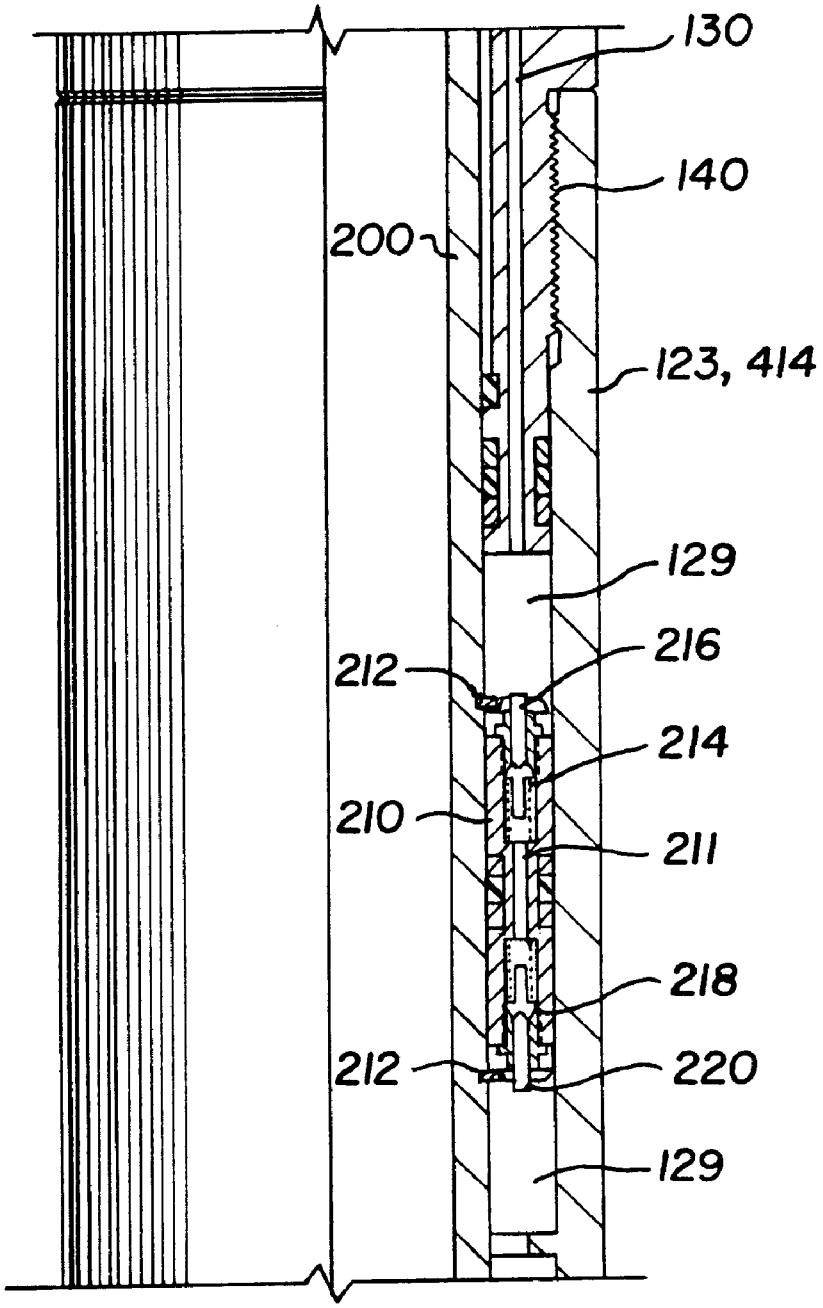
Figure 4D:
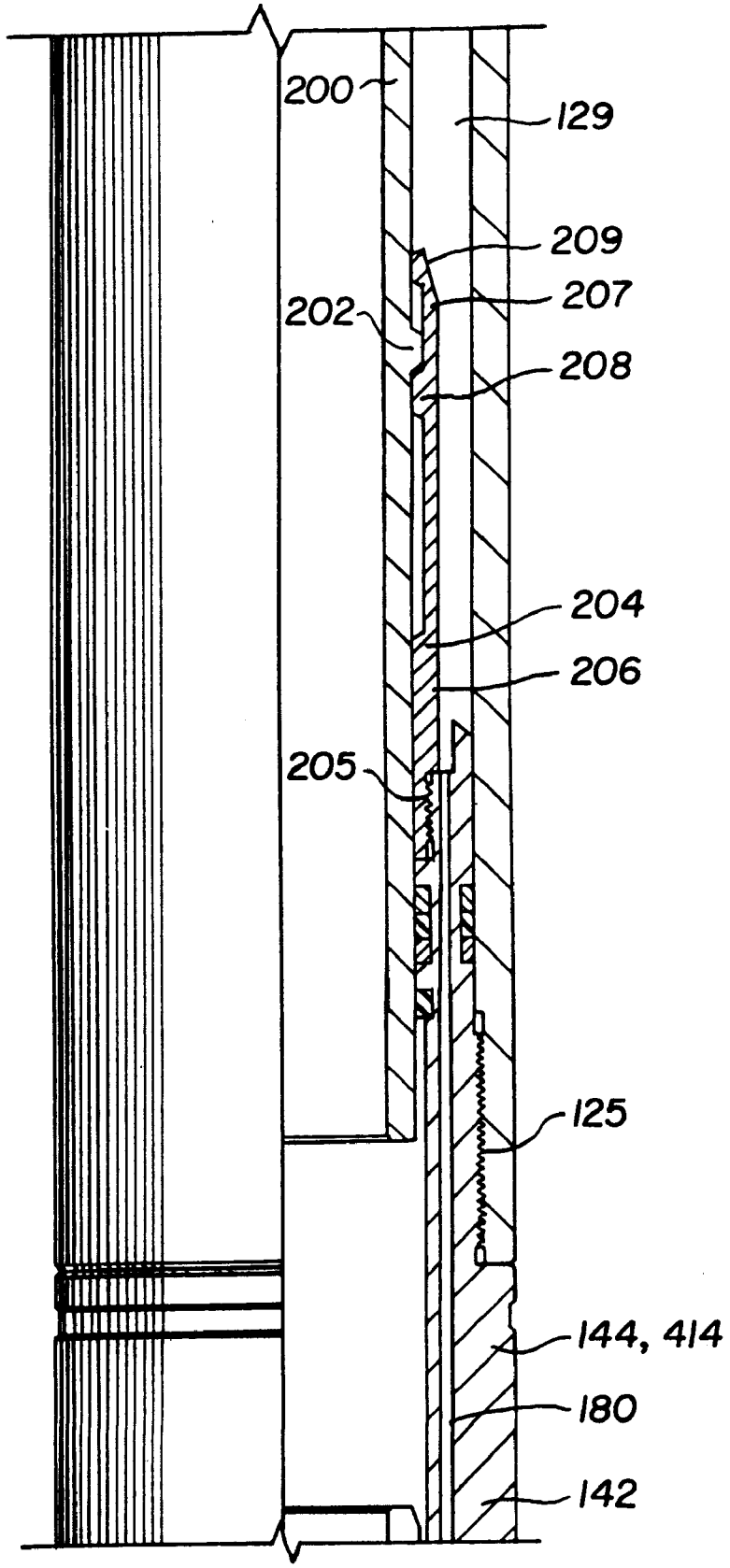
Figure 4E:
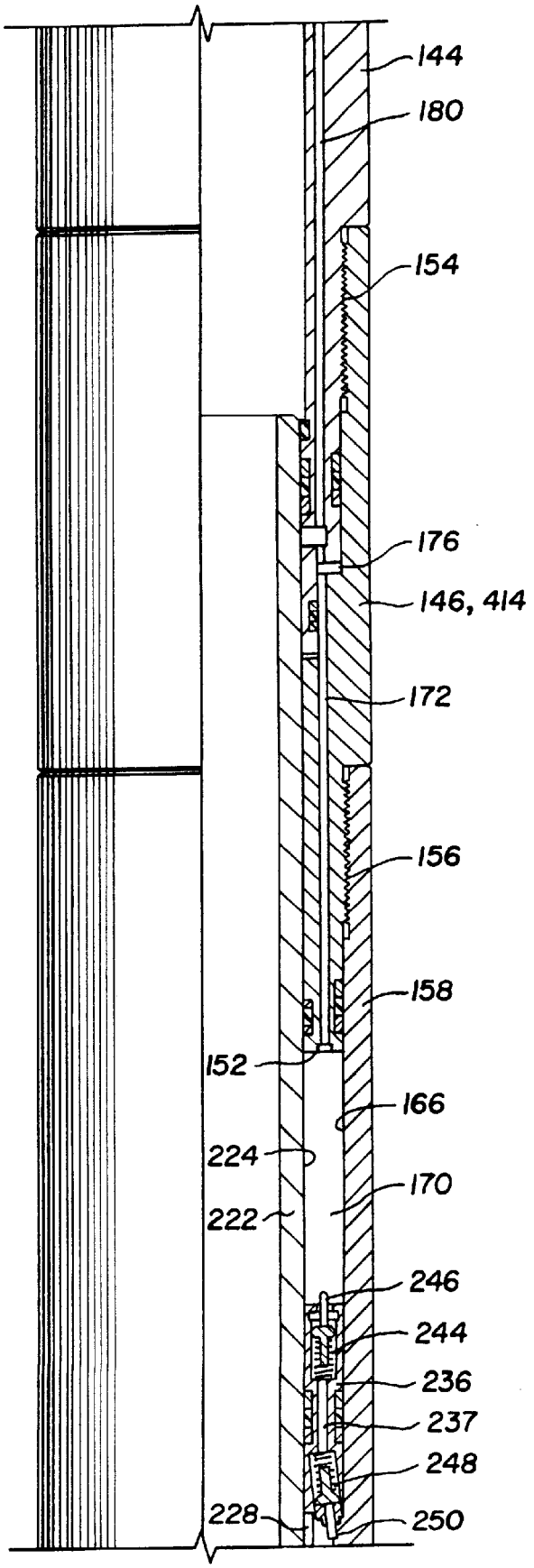
Figure 4F:
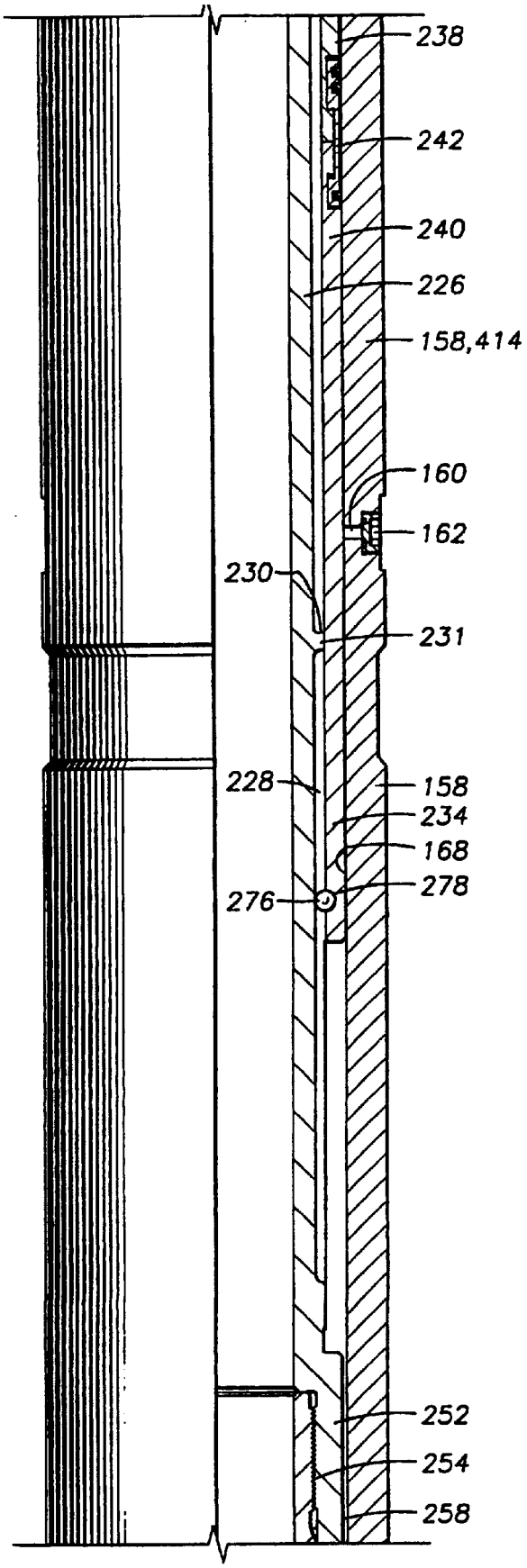
Figure 4G:
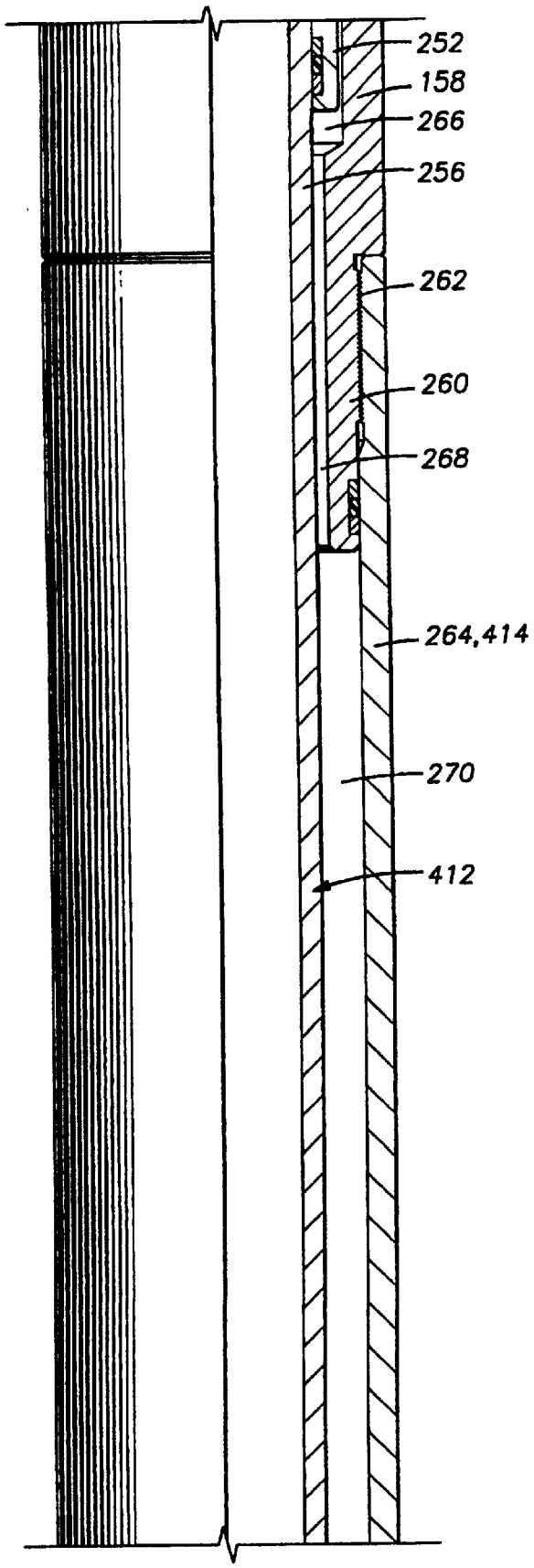
Figure 4H:
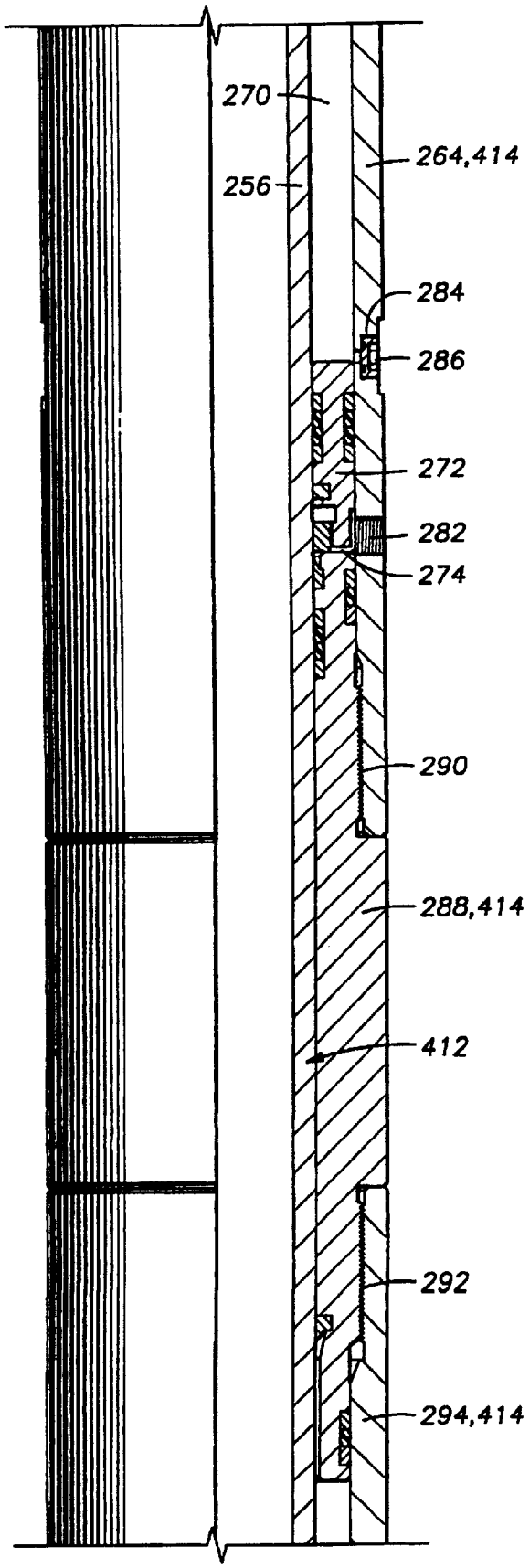
Figure 4J:
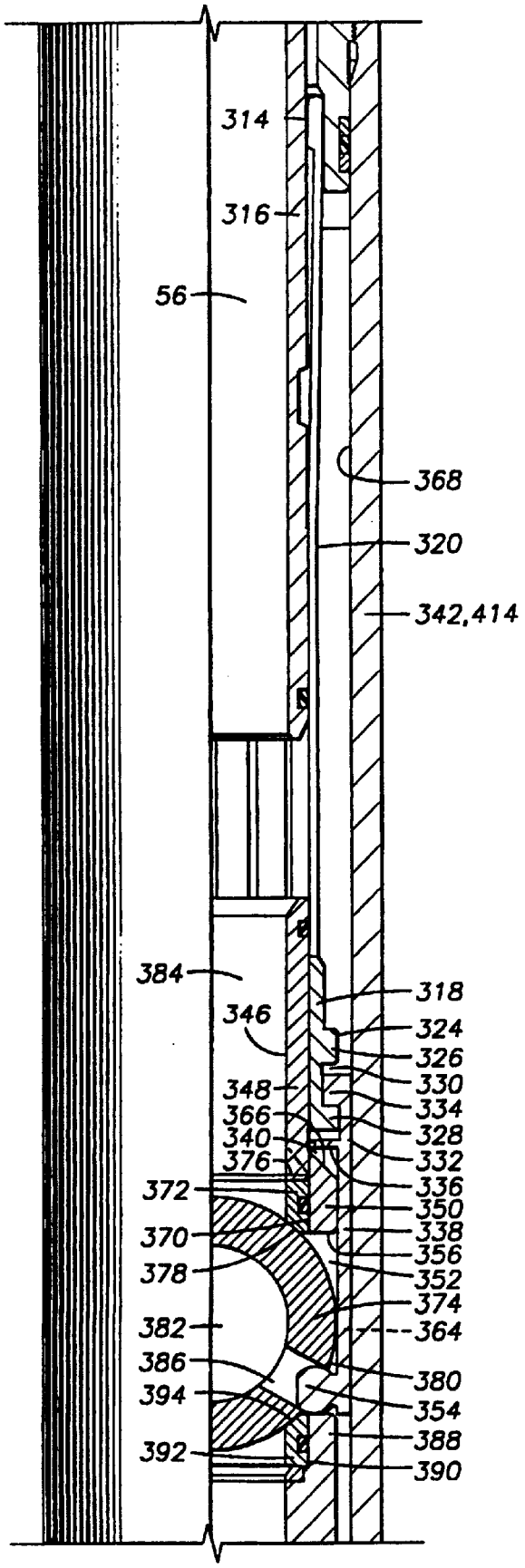
Figure 4K:
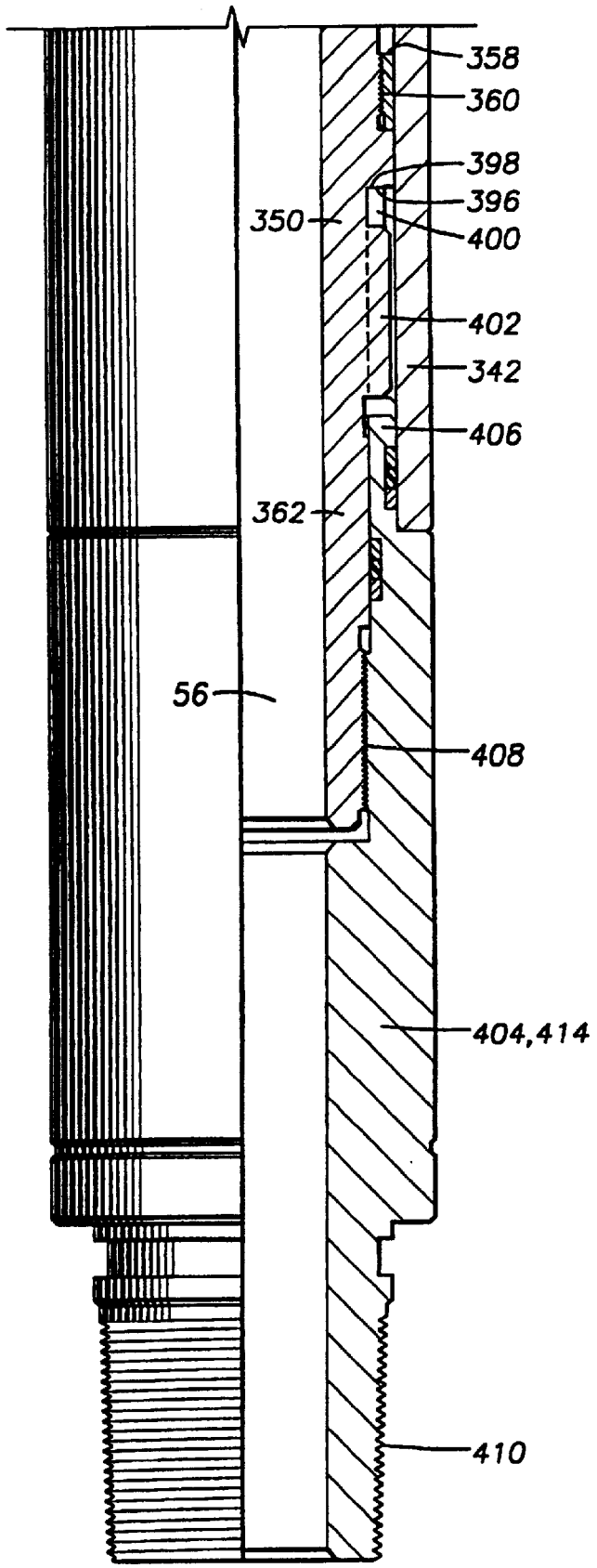

During a subsequent well annulus pressure increase and decrease cycle, balls 276 are moved along slot 228 to ball position e sub 1. This will have the effect of moving the operating mandrel assembly 412 further downward with respect to the exterior housing 414. However, the fluid circulating assembly 416 remains closed. To prevent damage to the valve ball 374 and its surrounding parts as a result of excessive downward movement of the operating mandrel assembly 412, protuberances 322 may become disengaged from recess 314 as shown in FIG. 4J.

As well annulus pressure is increased and decreased once more, the balls 276 are moved from ball position e sub 1 to position f sub 1 causing the tool 50 to be moved into its circulating position. In this position, as shown in FIGS. 4E–4K, the valve ball 374 remains closed and the fluid circulating assembly 416 is opened by the alignment of the circulation ports 296 and valve apertures 304 to permit fluid communication between the central flow conducting passage 56 and the well bore annulus 46. The tool 50 will remain in the circulating position during subsequent annulus pressure change cycles where the balls 276 are moved sequentially to positions f sub 2, f sub 3, f sub 4, f sub 5, f sub 6 and f sub 7.

By way of further explanation of the mode changing and operating sequence of tool 50, the reader should note that the tool only changes mode when balls 276 shoulder at specific positions on slot 228 during cycling of the tool since ratchet operation dictates the position of the operating mandrel assembly 412 within the housing 414. For example, tool 50 changes mode at positions d sub 1, f sub 1, f sub 7 and d sub 2.

It is also noted that movement between some ball positions is effected by annulus pressure decrease followed by an increase rather than the increase/decrease cycle described above. With respect to FIG. 5, specifically, movement from f sub 6 to f sub 7, from f sub 7 to e sub 2 and from e sub 2 to d sub 2 is accomplished this way.

The present invention is described with respect to preferred embodiments, but is not limited to those described. For example, the ratchet slot 228 design may be altered to feature different test positions. Alternatively, the tool 50 might be programmed to effect modes of operation other than those disclosed with respect to the preferred embodiments described herein. It will be readily apparent to one of ordinary skill in the art that numerous such modifications may be made to the invention without departing from the spirit and scope of it as claimed.

What is claimed is:

1. A pressure responsive well tool, the tool comprising:

(a) a housing having a flow conducting passage therethrough;

(b) a pressure conducting channel in the housing;

(c) a spring assembly in the housing for storing potential energy in response to an increase in fluid pressure within the pressure conducting channel and releasing the stored potential energy into the pressure conducting channel in response to a decrease in fluid pressure within the pressure conducting channel; and (d) a staged latching assembly operatively connected to the spring assembly for providing an intermediate stage pressure position for the spring assembly.

2. The pressure responsive well tool according to claim 1, wherein the pressure conducting channel further comprises a passageway in fluid communication with the exterior of the housing, whereby the well tool is controlled by changes in annulus pressure.

3. The pressure responsive well tool according to claim 1, wherein the spring assembly is a fluid spring assembly.

4. The pressure responsive well tool according to claim 3, wherein the fluid spring assembly comprises: a pressurized gas chamber and a piston.

5. The pressure responsive well tool according to claim 1, wherein the staged latching assembly comprises:

(a) a mandrel slidably disposed within the housing and operatively connected to the spring assembly;

(b) a plurality of collet fingers connected to the housing; and (c) interfering structures on the mandrel and the collet fingers for providing the intermediate stage pressure position.

6. The pressure responsive well tool according to claim 5, wherein the interfering structures on the mandrel and on the collet fingers slip the different fluid pressures within the pressure conducting channel.

7. The pressure responsive well tool according to claim 5, wherein the interfering structures on the mandrel and the collet fingers further comprise:

(a) at least one circumferential lug on the exterior of the mandrel; and (b) at least two spaced-apart knuckles on the interior of each of the plurality of collet fingers.

8. The pressure responsive well tool according to claim 7, wherein the lug on the mandrel slips relative to the spaced-apart knuckles on the plurality of collet fingers at different fluid pressures within the pressure conducting channel.

9. The pressure responsive well tool according to claim 1, wherein:

(a) the spring assembly is moved from a first pressure position to a second pressure position in response to an increase in pressure within the pressure conducting channel;

(b) the spring assembly is moved from the second pressure position to an intermediate stage pressure position in response to a partial decrease in pressure within the pressure conducting channel;

(c) the spring assembly is moved from the intermediate stage pressure position to the first pressure position in response to a further decrease in pressure within the pressure conducting channel; and (d) the spring assembly is moved from the intermediate stage pressure position to the second pressure position in response to an increase in pressure within the pressure conducting channel;

thereby selectively controlling the first, second, and intermediate stage pressure positions of the spring assembly.

10. The pressure responsive well tool according to claim 1, further comprising:

(a) a ball valve in the housing for opening and closing the flow conducting passage;

(b) lateral circulation ports in the housing for circulating fluids between the flow conducting passage and the exterior of the housing;

(c) an operating mandrel assembly slidably disposed within the housing for opening and closing the ball valve and the lateral circulation ports, the operating mandrel operatively connected to the spring assembly; and (d) a ball and slot rachet assembly operatively connected to the operating mandrel and the housing that dictates movement of the operating mandrel assembly in response to pressure changes within the pressure conducting channel, the rachet assembly having a primary rachet slot path within which the ball is maintained during a primary mode of operation of the tool, and the rachet assembly having a secondary rachet slot path within which the ball is maintained during a secondary mode of operation of the tool, the secondary rachet slot path being contiguous with the primary rachet slot path;

whereby the intermediate stage pressure position of the spring assembly is used to selectively direct the ball between the primary rachet slot path into the secondary rachet slot path to provide selective opening and closing of the ball valve and the lateral circulation ports depending on whether the ball is in the primary or secondary rachet slot paths.

11. The pressure responsive well tool according to claim 10, wherein the pressure conducting channel further comprises a hydraulic fluid conducting channel having a shuttle piston and check valves for operatively connecting the operating mandrel to the spring assembly.

12. A pressure responsive well tool for use in a testing string in a well bore, the tool comprising:

(a) a housing defining a central flow conducting passage;

(b) a valve assembly within the housing operable between two positions, a first position wherein the flow conducting passage through the tool is blocked, and a second position, wherein the flow conducting passage is not blocked;

(c) a fluid circulating assembly within the housing operable between two positions, a first position wherein fluid is communicated between an external well bore annulus and the central flow conducting passage, and a second position wherein fluid communication between an external well bore annulus and the central flow conducting passage is blocked;

(d) a pressure conducting channel in the housing;

(e) a spring assembly in the housing for storing potential energy in response to an increase in fluid pressure within the pressure conducting channel and releasing the stored potential energy into the pressure conducting channel in response to a decrease in fluid pressure within the pressure conducting channel, the spring assembly having first and second pressure positions;

(f) a staged latching assembly operatively connected to the spring assembly for providing the intermediate stage pressure position for the spring assembly;

(g) an operating mandrel assembly slidably disposed within the housing and operably associated with the valve assembly and the fluid circulating assembly, the operating mandrel assembly being responsive to variations in pressure within the pressure conducting channel to move between a number of mandrel positions each of which correspond to preset positions for the valve assembly and for the fluid circulating assembly to configure the tool into distinct operative modes;

(h) a position controller to dictate response of the operating mandrel assembly to variations in pressure within the pressure conducting channel, the position controller providing a default position sequence wherein the operating mandrel assembly is maintained in primary mandrel positions during changes in pressure within the pressure conducting channel that move the spring assembly between the first and second pressure positions, the position controller being overrideable from the intermediate stage pressure position of the spring assembly to permit selective movement of the operating mandrel assembly into alternate mandrel positions.

13. The pressure responsive well tool according to claim 12, wherein the pressure conducting channel further comprises a passageway in fluid communication with the exterior of the housing, whereby the well tool is controlled by changes in annulus pressure.

14. The pressure responsive well tool according to claim 12, wherein the spring assembly is a fluid spring assembly.

15. The pressure responsive well tool according to claim 14, wherein the fluid spring assembly comprises: a pressurized gas chamber and a piston.

16. The pressure responsive well tool according to claim 15, wherein the staged latching assembly comprises:

(a) a mandrel slidably disposed within the housing and operatively connected to the piston;

(b) a plurality of collet fingers connected to the housing; and (c) interfering structures on the mandrel and the collet fingers for providing the intermediate stage pressure position.

17. The pressure responsive well tool according to claim 16, wherein the interfering structures on the mandrel and on the collet fingers slip at least two different fluid pressures within the pressure conducting channel.

18. The pressure responsive well tool according to claim 16, wherein the interfering structures on the mandrel and the collet fingers further comprise:

(a) at least one circumferential lug on the exterior of the mandrel; and (b) at least two spaced-apart knuckles on the interior of each of the plurality of collet fingers.

19. The pressure responsive well tool according to claim 18, wherein the lug on the mandrel slips relative to the spaced-apart knuckles on the plurality of collet fingers at different fluid pressures within the pressure conducting channel.

20. The pressure responsive well tool according to claim 12, wherein:

(a) the spring assembly is moved from a first pressure position to a second pressure position in response to an increase in pressure within the pressure conducting channel;

(b) the spring assembly is moved from the second pressure position to an intermediate stage pressure position in response to a partial decrease in pressure within the pressure conducting channel;

(c) the spring assembly is moved from the intermediate stage pressure position to the first pressure position in response to a further decrease in pressure within the pressure conducting channel; and (d) the spring assembly is moved from the intermediate stage pressure position to the second pressure position in response to an increase in pressure within the pressure conducting channel;

thereby selectively controlling the first, second, and intermediate stage pressure positions of the spring assembly.

21. The pressure responsive tool according to claim 12, wherein the position controller further comprises a ratchet assembly interrelating the operating mandrel assembly and the housing, the ratchet assembly comprising a ratchet path and a ratchet member which is movably received in and directable within the ratchet path.

22. The pressure responsive tool according to claim 21, wherein the default position sequence of the position controller is provided by a first cyclical ratchet path within which the ratchet member is directed to maintain the operating mandrel assembly in its primary mandrel positions.

23. The pressure responsive tool according to claim 22 wherein the position controller is overrideable by directing the ratchet member outside the first cyclical ratchet path and into a contiguous second ratchet path to move the operating mandrel assembly to alternate mandrel positions.

24. The pressure responsive tool according to claim 23 wherein the position controller is overrideable by directing the ratchet member into the second ratchet path at an intermediate stage pressure position of the fluid spring assembly.

25. The pressure responsive tool according to claim 23 wherein the ratchet member is directed into the second ratchet path from an intermediate state pressure position upon a change in annulus pressure.

26. A method of operating a well tool, the method comprising the steps of:

(a) providing a tool for use in a tubing string disposed in a well bore, the tool comprising:

(i) a housing having a flow conducting passage therethrough;

(ii) a pressure conducting channel in the housing;

(iii) a spring assembly in the housing for storing potential energy in response to an increase in fluid pressure within the pressure conducting channel and releasing the stored potential energy into the pressure conducting channel in response to a decrease in fluid pressure within the pressure conducting channel; and (iv) a staged latching assembly operatively connected to the spring assembly for providing at least one intermediate stage pressure position for the spring assembly;

(b) changing the pressure in the pressure conducting channel to configure the tool into a mode in which the spring assembly is in the intermediate stage pressure position; and (c) selectively increasing or decreasing the pressure in the pressure conducting channel to configure the tool into a mode in which the spring assembly is in a first pressure position or a second pressure position, respectively.

27. The method of operating a well tool according to claim 26, wherein the pressure conducting channel further comprises a passageway in fluid communication with the exterior of the housing, whereby the pressure in the pressure conducting channel in the housing is controlled by changes in annulus pressure.

28. The method of operating a well tool according to claim 26, wherein the spring assembly is a fluid spring assembly.

29. The method of operating a well tool according to claim 28, wherein the fluid spring assembly comprises: a pressurized gas chamber and a piston.

30. The method of operating a well tool according to claim 29, wherein the staged latching assembly comprises:

(a) a mandrel slidably disposed within the housing and operatively connected to the piston;

(b) a plurality of collet fingers connected to the housing; and (c) interfering structures on the mandrel and the collet fingers for providing the intermediate stage pressure position.

31. The method of operating a well tool according to claim 30, wherein the interfering structures on the mandrel and on the collet fingers slip at least two different fluid pressures within the pressure conducting channel.

32. The method of operating a well tool according to claim 30, wherein the interfering structures on the mandrel and the collet fingers further comprise:

(a) at least one circumferential lug on the exterior of the mandrel; and (b) at least two spaced-apart knuckles on the interior of each of the plurality of collet fingers.

33. The method of operating a well tool according to claim 32, wherein the lug on the mandrel slips relative to the spaced-apart knuckles on the plurality of collet fingers at different fluid pressures within the pressure conducting channel.

34. The method of operating a well tool according to claim 26, wherein the step of changing the pressure in the pressure conducting channel to configure the tool into a mode in which the spring assembly is in the intermediate stage pressure position further comprises the steps of:

(a) increasing the pressure within the pressure conducting channel to move the spring assembly from a first pressure position to a second pressure position; and (b) partially decreasing the pressure within the pressure conducting channel to move the spring assembly from the second pressure position to the intermediate stage pressure position.

35. The method of operating a well tool according to claim 34, wherein the step of selectively increasing or decreasing the pressure in the pressure conducting channel to configure the tool into a mode in which the spring assembly is in a first pressure position or a second pressure position, respectively further comprises the steps of:

(d) selectively increasing the pressure within the pressure conducting channel to move the spring assembly from the intermediate stage pressure position to the second pressure position; or (e) selectively decreasing the pressure within the pressure conducting channel to move the spring assembly from the intermediate stage pressure position to the first pressure position.

36. The method of operating a well tool according to claim 26, wherein the tool further comprises:

(a) a ball valve in the housing for opening and closing the flow conducting passage;

(b) lateral circulation ports in the housing for circulating fluids between the flow conducting passage and the exterior of the housing;

(c) an operating mandrel assembly slidably disposed within the housing for opening and closing the ball valve and the lateral circulation ports, the operating mandrel operatively connected to the spring assembly; and (d) a ball and slot rachet assembly operatively connected to the operating mandrel and the housing that dictates movement of the operating mandrel assembly in response to pressure changes within the pressure conducting channel, the rachet assembly having a primary rachet slot path within which at least one ball is maintained during a primary mode of operation of the tool, and the rachet assembly having a secondary rachet slot path within which the ball is maintained during a secondary mode of operation of the tool, the secondary rachet slot path being contiguous with the primary rachet slot path;

whereby the intermediate stage pressure position of the spring assembly is used to selectively direct the ball between the primary rachet slot path into the secondary rachet slot path to provide selective opening and closing of the ball valve and the lateral circulation ports depending on whether the ball is in the primary or secondary rachet slot paths.

37. A method of operating a multi-mode well tool comprising the steps of:

(a) providing a tool for use in a testing string disposed in a well bore, the tool comprising:

(i) a housing defining a central flow conducting passage;

(ii) an valve assembly within the housing operable between two positions, a first position wherein the flow conducting passage through the tool is blocked, and a second position, wherein the flow conducting passage is not blocked;

(iii) a fluid circulating assembly within the housing operable between two positions, a first position wherein fluid is communicated between an external well bore annulus and the central flow conducting passage, and a second position wherein fluid communication between an external well bore annulus and the central flow conducting passage is blocked;

(iv) a pressure conducting channel in the housing;

(v) a spring assembly in the housing for storing potential energy in response to an increase in fluid pressure within the pressure conducting channel and releasing the stored potential energy into the pressure conducting channel in response to a decrease in fluid pressure within the pressure conducting channel, the spring assembly having first and second pressure positions;

(vi) a staged latching assembly operatively connected to the spring assembly for providing at least one intermediate stage pressure position for the spring assembly;

(vii) an operating mandrel assembly slidably disposed within the housing and operably associated with the valve assembly and the fluid circulating assembly, the operating mandrel assembly being responsive to variations in pressure within the pressure conducting channel to move between a number of mandrel positions each of which correspond to preset positions for the valve assembly and for the fluid circulating assembly to configure the tool into distinct operative modes;

(viii) a position controller to dictate response of the operating mandrel assembly to variations in pressure within the pressure conducting channel, the position controller providing a default position sequence wherein the operating mandrel assembly is maintained in primary mandrel positions during changes in pressure within the pressure conducting channel that move the spring assembly between the first and second pressure positions, the position controller being overrideable from the intermediate stage pressure position of the spring assembly to permit selective movement of the operating mandrel assembly into an alternate position sequence wherein the operating mandrel assembly has alternative mandrel positions;

(b) operating the tool such that the position controller is maintained in the default position sequence; and (c) selectively overriding the position controller to redirect the operating mandrel assembly into the alternate position sequence.

38. The method of operating a multi-mode well tool according to claim 37, wherein the spring assembly is a fluid spring assembly.

39. The method of operating a multi-mode well tool according to claim 37, wherein the fluid spring assembly comprises: a pressurized gas chamber and a piston.

40. The method of operating a multi-mode well tool according to claim 39, wherein the staged latching assembly comprises:

(a) a mandrel slidably disposed within the housing and operatively connected to the piston;

(b) a plurality of collet fingers connected to the housing; and (c) interfering structures on the mandrel and the collet fingers for providing the intermediate stage pressure position.

41. The method of operating a multi-mode well tool according to claim 39, wherein the interfering structures on the mandrel and on the collet fingers slip at least two different fluid pressures within the pressure conducting channel.

42. The method of operating a multi-mode well tool according to claim 39, wherein the interfering structures on the mandrel and the collet fingers further comprise:

(a) at least one circumferential lug on the exterior of the mandrel; and (b) at least two spaced-apart knuckles on the interior of each of the plurality of collet fingers.

43. The method of operating a multi-mode well tool according to claim 41, wherein the lug on the mandrel slips relative to the spaced-apart knuckles on the plurality of collet fingers at different fluid pressures within the pressure conducting channel.

44. The method of operating a multi-mode well tool according to claim 37, further comprising the step of changing the pressure in the pressure conducting channel to configure the tool into a mode in which the spring assembly is in the intermediate stage pressure position.

45. The method of operating a multi-mode well tool according to claim 37, farther comprising the step of changing the pressure in the pressure conducting channel to configure the tool into a mode in which the spring assembly is in the intermediate stage pressure position further comprises the steps of:

(a) increasing the pressure within the pressure conducting channel to move the spring assembly from a first pressure position to a second pressure position; and (b) partially decreasing the pressure within the pressure conducting channel to move the spring assembly from the second pressure position to the intermediate stage pressure position.

46. The method of operating a multi-mode well tool according to claim 45, wherein the step of selectively overriding the position controller to redirect the operating mandrel assembly into the alternate mandrel positions further comprises the step of:

selectively increasing the pressure within the pressure conducting channel to move the spring assembly from the intermediate stage pressure position to the second pressure position.

47. The method of operating a multi-mode well tool according to claim 37, wherein the default position sequence is a well test mode in which the valve assembly is in the second position and the fluid circulating assembly in the second position.

48. The method of operating a multi-mode well tool according to claim 47, wherein the alternative position sequence comprises a blank configuration in which the valve assembly is in its first position and the circulating assembly is in its second position.

49. The method of operating a multi-mode well tool according to claim 47, wherein the alternative position sequence comprises a fluid circulating configuration in which the valve assembly is in its first position and the circulating assembly is in its first position.

* * * * *